US007407200B2

(12) United States Patent
Ichimaru

(10) Patent No.: US 7,407,200 B2
(45) **Date of Patent: *Aug. 5, 2008**

(54) COVER OPENING AND CLOSING DEVICE

(75) Inventor: Takahide Ichimaru, Chigasaki (JP)

(73) Assignee: NIFCO Inc., Yokohama-shi, Kanagawa (JP)

( * ) Notice: Subject to any disclaimer, the term of this patent is extended or adjusted under 35 U.S.C. 154(b) by 219 days.

This patent is subject to a terminal disclaimer.

(21) Appl. No.: 11/116,306

(22) Filed: Apr. 28, 2005

(65) Prior Publication Data

US 2005/0252759 A1 Nov. 17, 2005

(30) Foreign Application Priority Data

May 11, 2004 (JP) ..... 2004-141616

(51) Int. Cl.
*E05C 3/02* (2006.01)

(52) U.S. Cl. ..... 292/194; 292/DIG. 37; 292/DIG. 4; 296/37.8

(58) Field of Classification Search ..... 292/194, 292/DIG. 37, 280, DIG. 4; 200/293, 520, 200/523–526; 74/99 R, 608, 609, 612; 49/503, 49/394; 296/24.34, 37.8
See application file for complete search history.

(56) References Cited

U.S. PATENT DOCUMENTS 5,121,521 A * 6/1992 Hagiwara et al. ..... 16/278
5,209,016 A * 5/1993 Yamada ..... 49/193
5,901,885 A * 5/1999 Iida ..... 222/517
5,988,709 A * 11/1999 Lee et al. ..... 292/199
6,789,831 B2 * 9/2004 Schmidt et al. ..... 296/37.13
6,832,412 B2 * 12/2004 Kim ..... 16/354
7,064,285 B2 * 6/2006 Ichimaru ..... 200/293
2003/0080121 A1 * 5/2003 Watkins ..... 219/759

FOREIGN PATENT DOCUMENTS

JP 02146307 A * 6/1990
JP 11-278514 10/1999
JP 2002-362237 12/2002

* cited by examiner

*Primary Examiner*—Patricia Engle
*Assistant Examiner*—Mark Williams
(74) *Attorney, Agent, or Firm*—Manabu Kanesaka

(57) ABSTRACT

A cover opening and closing device switches a cover body to rotate between a closed position and an open position. The cover opening and closing device includes a single operation button for switching the cover body between the closed position and the open position, a forcing device for forcing the cover body at least toward the closed position from a near closed position when the cover body is closed, and a switching device for releasing the cover body in the open position and allowing the cover body to rotate toward the closed position when the operation button is pushed.

3 Claims, 24 Drawing Sheets

(b)

COVER OPENING AND CLOSING DEVICE

BACKGROUND OF THE INVENTION AND RELATED ART STATEMENT

The present invention relates to a cover opening and closing device for switching a cover body between an open position and a closed position relative to a corresponding surface (for example, an opening or operating panel of switches, and the like) of a main body.

A cover opening and closing device used on a vehicle console or the like has been disclosed in Japanese Patent Publication (Kokai) No. 2003-129742. A cover body is usually forced toward an open position by a forcing device. A cover body is switched from the open position to a closed position in opposition to the force of the forcing device, and stays at the closed position by holding a catching claw on the cover body to a latch on the main body in the closed position. In a case that the cover body is divided into two parts, an idle gear or the like is interposed between the two parts for synchronously switching each part between the open position and the closed position. The latch releases the catching claw by pressing an operation button and allows the cover body to switch from the closed position to the open position. Hereunder, this type is called a former mechanism.

FIGS. 24(*a*) and 24(*b*) show a cover opening and closing device disclosed in Patent Document 1. The cover opening and closing device synchronously switches cover bodies (door bodies) 14 and 16 divided into two parts between the open position and the closed position. The cover opening and closing device comprises an open button 18 and a close button 20; Z-shaped arms 58 and 64; a rotating body 32 as a large gear; and an invertible-type spring 50 with one end 50A fixed to a coupling groove 44 of the rotating body 32 and the other end 50B supported by a shaft 52 on a main body. The open button 18 is linked to one end 58A of the arm 58 through a shaft 54, and the close button 20 is linked to one end 64A of the arm 64 through a shaft 60. A small gear 30 is disposed on the cover body 16 for engaging the rotating body 32. A small gear 38 is provided on the side surface opposite the side where the arm 58 inside the cover body 14. The small gear 38 engages a small gear on the corresponding side of the cover body 16 through an idle gear.

In the mechanism, when the open button 18 is pushed while the cover bodies 14 and 16 are in the closed position as shown in FIG. 24(*a*), the arm 58 rotates around a shaft 66 coupled in a hole 68. The lower end front end part 58C of the arm 58 presses the linking part 50A of the spring 50, and moves along the coupling groove 44 of the rotating body 32 from the left side end part 44A (stable point) toward the right side end part 44B. The linking part 50A of the spring 50 passes the neutral point and moves toward the right side end part 44B of the coupling groove 44. Accordingly, the rotating body 32 is subjected to a force causing the rotating body 32 to rotate in the counterclockwise direction as a partial force of the spring 50. Therefore, even if the hand is removed from the open button 18, the rotating body 32 rotates the cover bodies 14 and 16 toward the open direction by the force of the spring 50.

On the other hand, when the close button 20 is pushed while the cover bodies 14 and 16 are in the open position as shown in FIG. 24(*b*), the arm 64 rotates around the shaft 66. The lower end front end part 64C of the arm 64 moves the linking part 50A of the spring 50 along the coupling groove 44 from the right side end part 44B (stable point) toward the left side end part 44A. When the linking part 50A of the spring 50 passes the neutral point and moves toward the end part 44A of the coupling groove 44, the rotating body 32 is subjected to a force causing the rotating body 32 to rotate in the clockwise direction as a partial force of the spring 50. Therefore, even if the hand is removed from the close button 20, the rotating body 32 rotates the cover bodies 14 and 16 toward the closed direction by the force of the spring 50.

Patent Document 1: Japanese Patent Publication (Kokai) No. 2002-362237

In the former mechanism, the catching claw on the latch is released by the push operation of the button, and the cover body is automatically switched from the closed position to the open position by the force of the forcing device. However, in the mechanism, in the case of switching the cover body from the open position to the closed position, it is necessary to move the cover body toward the closed position while pushing the button opposition to the force of the forcing device with the hand or finger, thereby lowering quality. In an automobile and the like, it is necessary to assuredly prevent misfiring in which the latch releases the catching claw by a load applied during a collision and the cover body is switched to the open direction unexpectedly, thereby making the structure complex.

In the mechanism shown in FIGS. 24(*a*) and 24(*b*), there is a risk that the driver or passenger might push a wrong button as the open button and the close button are placed in parallel. There also is a risk that the cover body might be automatically switched to the open position when the wrong button is pushed, thereby causing a safety issue. Also, it is preferable to provide a single operation button rather than two buttons from placement and design point of view.

In view of the problems described above, an object of the present invention is to provide a cover opening and closing device with a simple structure. It is possible to improve quality, and to assuredly eliminate the risk that the cover body might be switched to the open position unexpectedly by an impact load caused by a collision accident or the like thereby making it easy to improve quality and expand an application.

Further objects and advantages of the invention will be apparent from the following description of the invention.

SUMMARY OF THE INVENTION

In order to achieve the objects described above, according to a first aspect of the present invention, a common constitution is applied to a first embodiment, modified examples, and a second embodiment. A cover opening and closing device switches a cover body to rotate on a corresponding surface of a main body between a closed position for closing the corresponding surface and an open position for opening the same. The cover opening and closing device comprises: a single operation button for switching the cover body between the closed position and the open position; a forcing device for forcing the cover body at least toward the closed position from a near closed position when the cover body is closed; and a switching device for releasing the cover body in the open position and allowing the cover body to rotate toward the closed position when the operation button is pushed.

In the present invention, the single operation button is provided. Accordingly, there is no risk that the button might be mistakenly pushed compared with a structure having an open button and a close button disclosed in Patent Document 1. In addition, a space of the button is halved, and it is easy to improve an appearance. The cover body is forced at least toward the closed position from the near closed position (a mid-course position between the closed and open positions). Accordingly, there is no risk that the safety might be impaired by the cover body unexpectedly switched from the closed position to the open position by misfiring of the latch as conventionally.

According to a second aspect of the present invention, the switching device has a cam rotating when the operation button is pushed and a gear linked with the cam for engaging a gear part provided on the cover body. The switching device also has a constituent member as an engaging device for holding the cover body at the open position and releasing the cover body when the operation button is pushed. According to a third aspect of the present invention, the switching device has a gear mechanism disposed between the cam and the gear for increasing a force. According to a fourth aspect of the present invention, the engaging device has a catching claw provided on the gear and a latch provided on the main body for engaging the catching claw. According to a fifth aspect of the present invention, the engaging device has a sliding body disposed between the operation button and the cam and formed of a cam groove, a trace pin for tracing the cam groove, and a lock member operationally linked with the sliding body for advancing and retreating in a direction roughly intersecting with the sliding body.

According to a sixth aspect of the present invention, the forcing device switches the forcing direction when the cover body is at a mid-course position between the closed position and the open position. According to a seventh aspect of the present invention, the switching device has a moving body operationally linked to the push operation of the operation button and sliding in a direction roughly intersecting with the direction of movement of the button; a push supported on the moving body to be rotatable; and a gear operationally linked to the push for engaging a gear part provided on the cover body. The switching device also has a constituent member as an engaging device for holding the cover body in the open position and releasing the cover body when the operation button is pushed. According to an eighth aspect of the present invention, the engaging device has a cam groove provided in a fixed plate fixed at a position on the main body, and a trace pin provided on the push for tracing the cam groove.

According to a ninth aspect of the present invention, in the cover opening and closing device in one of the first to eighth aspects, the cover body is divided in two portions, and has a power transmitting device for switching the cover body between the open position and the closed position with one cover body linked to the other cover body operationally linked to the switching device. According to a tenth aspect of the present invention, the cover opening and closing device in one of the first to ninth aspects has a damper device for damping the opening and closing speed of the cover body.

The cover opening and closing device of the present invention has the following advantages. In the first aspect, the operation button is singular compared with a conventional structure having an open button and a close button. Accordingly, there is no risk that the button might be mistakenly pushed, the space for placement of the button is halved, and the external design characteristics can be improved. At the same time, the cover body is forced at least toward the direction of the closed position from the mid-course position, so that the cover body is not switched unexpectedly from the closed position to the open position even due to misfiring of the engaging device. Therefore, in the structure, a problem of eliminating the occurrence of misfiring due to collision load in a conventional engaging device such as a latch is alleviated, and consequently it is possible to make the engaging device simple and reduce cost.

In the second aspect, the cover body is smoothly opened and closed by the switching device having the cam rotated by the push operation of the button and the gear operationally linked to the cam. The switching device has the constituent member as the engaging device, thereby making an installation space small. In the third aspect, the gear mechanism is disposed between the cam and the gear, so that the pushing force on the operation button does not become greater than necessary, and the operability of the button can be made better by controlling the amount of pushing of the button. The pushing force on the button is transmitted to the cam, gear, cover body, and power transmitting device, and the gear mechanism is provided for reducing the pushing force on the button.

In the fourth aspect, the engaging device comprises the catching claw and the latch for engaging and releasing the catching claw. Accordingly, the push-push catching mechanism with superior operability such as the latch is adopted such that the advantages thereof can be provided. In the fifth aspect, the push-push catching mechanism is constituted by the cam groove of the sliding body and the trace pin for tracing the cam groove. The cover body moves slightly toward the open direction when the catching claw is released like a conventional push-push catching mechanism. The lock member is provided for eliminating the slight movement of the cover, thereby improving convenience.

In the sixth aspect, the forcing device switches the forcing direction of the cover body at the mid-course of rotation, when the user switches the cover body from the closed position to the open position or from the open position to the closed position by the push operation of the button. After the button is pushed slightly, the cover body is switched by the force of the forcing device. Therefore, the operability of switching can be made better, and in addition, the engaging device for holding the cover body in the open position can be simplified. In the seventh aspect, by the push operation of the button, i.e., the switching device, the cover body is opened and closed smoothly via the moving body sliding, the push supported on the moving body to be rotatable, and the gear operationally linked to the push. The switching device has the constituent member as the engaging device, thereby reducing an installation space.

In the eighth aspect, the push-push catching mechanism is constituted by the trace pin provided on the push and the cam groove in the main body (fixed position). The cover body moves slightly toward the open direction when the catching claw is released as in a conventional push-push catching mechanism. The slight movement of the cover is eliminated and the convenience of use can be improved.

In the ninth aspect, when the cover body is divided into the two parts, each cover body can be opened and closed in linkage by the power transmitting device. In the tenth aspect, the opening and closing speed of the cover body is damped by the damper device. Accordingly, a sudden movement of the cover body is eliminated, thereby improving operating characteristic.

DETAILED DESCRIPTION OF PREFERRED EMBODIMENTS

Figure 1A:
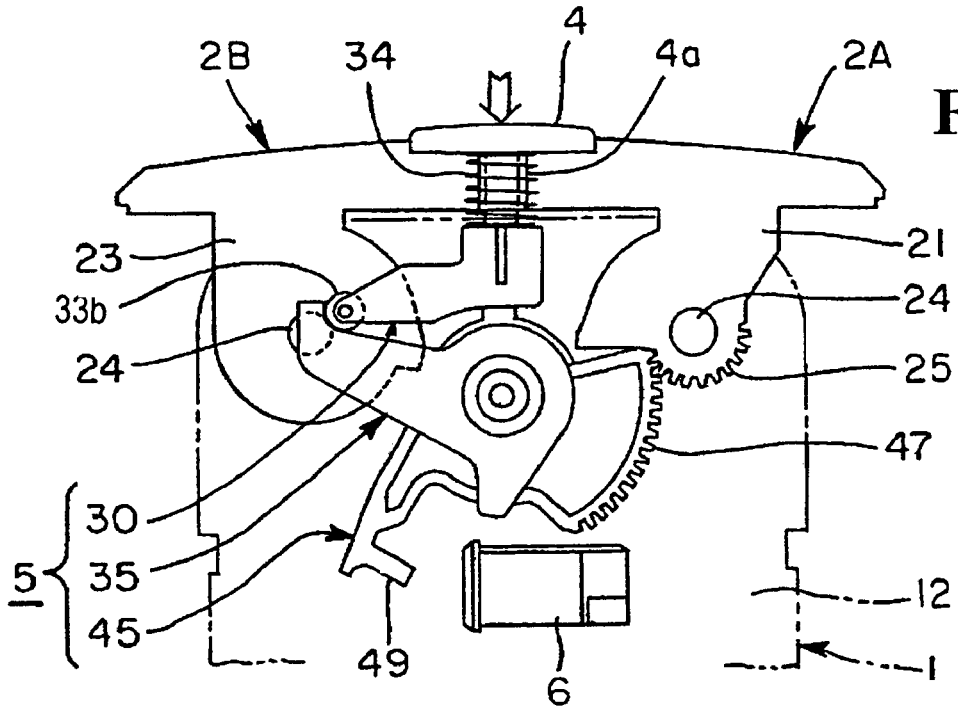
FIGS. 1(*a*) and 1(*b*) are schematic views showing a cover opening and closing device viewed from one side in a front-to-back direction of a main body according to a first embodiment of the present invention.
Figure 1B:
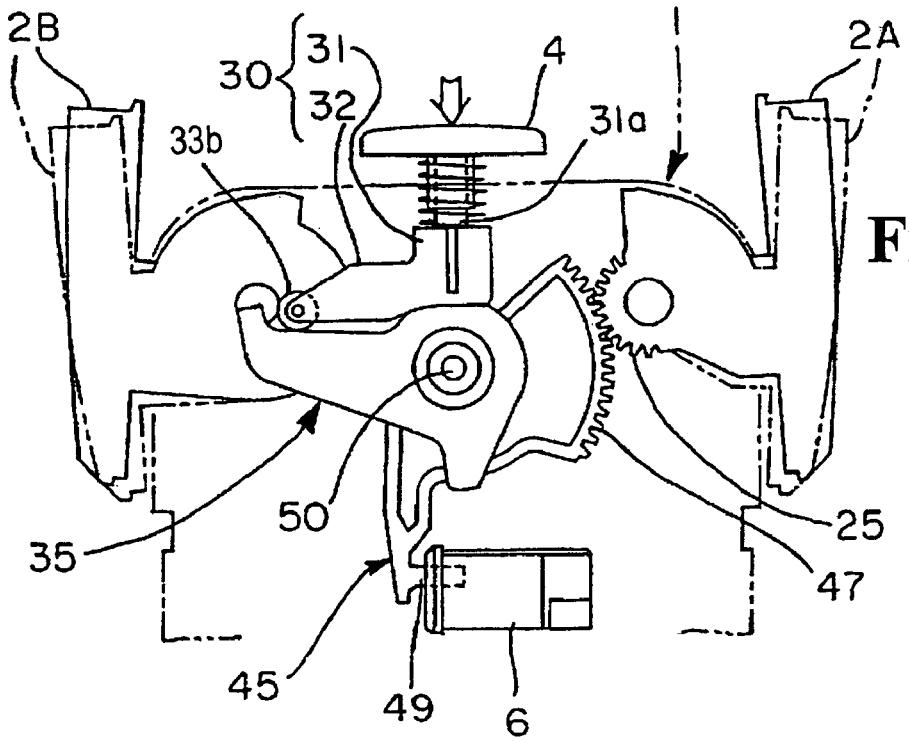

Hereunder, embodiments of the present invention will be explained with reference to the accompanying drawings. FIGS. 1(*a*) and 1(*b*) to FIGS. 8(*a*) and 8(*b*) show the first embodiment (fundamental mode of the present invention and modified example 1 thereof). FIG. 9 to FIGS. 14(*a*) and 14(*b*) show modified example 2 in which the engaging device of the first embodiment is changed. FIG. 15 to FIGS. 23(*a*) and 23(*b*) show the second embodiment. In the first embodiment, FIGS. 1(*a*) and 1(*b*) to FIGS. 6(*a*) and 6(*b*) show a constitution having the cover body divided into two parts, and FIGS. 7(*a*) and 7(*b*) and FIGS. 8(*a*) and 8(*b*) are typical operational drawings extended to a single cover body structure. In the drawings, parts of members are omitted or typified due to constraints in the drawing. In the explanation below, after giving an overview of each embodiment, the first embodiment, modified examples, and second embodiment are described in detail successively. In each explanation, the same symbols are assigned to the members and parts that are operationally the same, and redundant descriptions are omitted to the extent possible.

(Outline) The cover opening and closing device of the present invention switches a cover body 2 or cover bodies 2A and 2B to rotate on a corresponding part (opening or operating panel of switches, or the like) of a main body 1 between a closed position for closing the corresponding part and an open position for opening the same by a push operation of a single operation button 4 or 4A. A constitution in which the cover bodies 2A and 2B are divided into two parts (below, called divided cover mode) as in FIGS. 1(*a*) and 1(*b*) to FIGS. 6(*a*) and 6(*b*), and FIG. 9 to FIGS. 23(*a*) and 23(*b*), or a constitution in which the cover body 2 consists of a single part (below, called single cover mode) as in FIGS. 7(*a*) and 7(*b*) and FIGS. 8(*a*) and 8(*b*) can be applied. The cover body is used in the same sense as a door or cover, or the like. A main body is used in the same sense as a housing or case of a machine or device. Also, in the case of the divided cover mode, compared with the single cover mode, a power transmitting device 7 which enables switching with one cover body 2B linked to the other cover body 2A is added.

First Embodiment

Figure 6A:
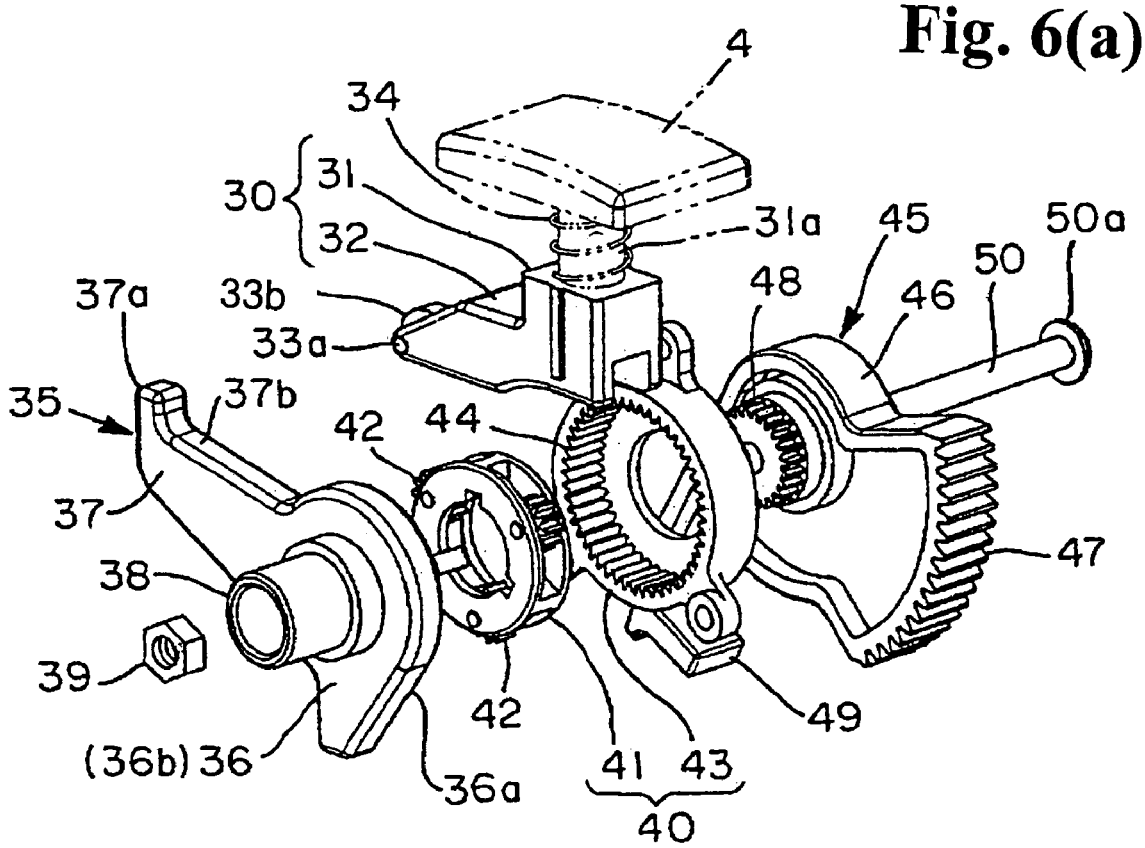
FIGS. 6(*a*) and 6(*b*) are views showing essential components of a switching device of the cover opening and closing device.
Figure 6B:
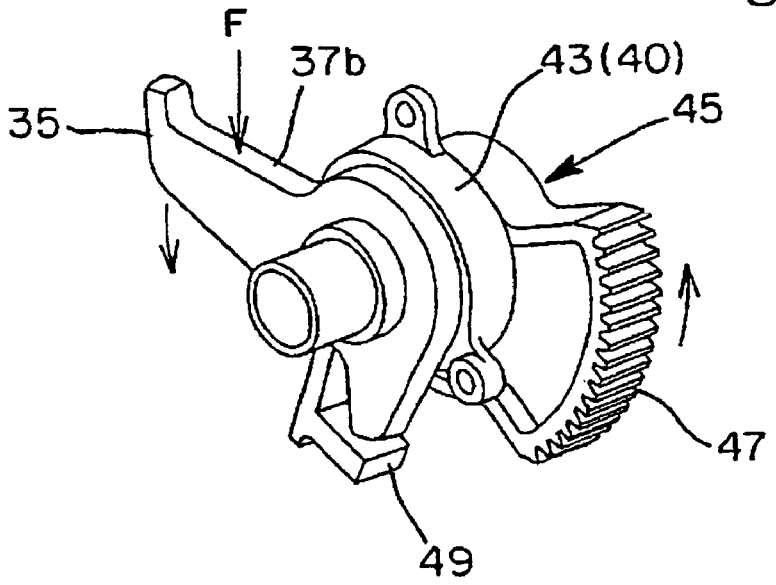

The cover opening and closing device of the first embodiment shown in FIGS. 1(*a*) and 1(*b*) to FIGS. 6(*a*) and 6(*b*), just as in Patent Document 1, is made as a mechanism for opening and closing an upper opening of a main body 1 which is housed inside a rectangular box-shaped housing part formed by an automobile console box. The apparatus or mechanism comprises a coil spring 3 as a forcing device, an operation button 4, a switching device 5, a latch 6, a power transmitting device 7, and a damper device 8. The switching device 5 is constituted by a cam 35 which is rocked or rotated by a movable body 30 by a push operation of the button 4, an acceleration gear 45 which is linked to the cam 35 by a force amplifying gear mechanism 40, and a catching claw 49 which is provided on a part of the acceleration gear 45, and the like.

The main body 1 is partitioned by front and rear walls 11 and 12, a bottom wall 13, and reinforcing pieces or projecting walls 14 provided on both sides of the bottom wall 13, and the entirety is incorporated in a condition being housed inside the recess of the housing part. The main body 1 has an attachment part 15 protruding on the front wall 11, bracket attachment parts 16 and 17 protruding on the rear wall 12, and a shaft pass-through hole (not illustrated) provided in the rear wall 12. A border member 10 is installed on the perimeter on the recess of the housing part. On that border member 10, a recessed part 10*a* for placing a button 4 to move up and down freely is provided in a location corresponding to the rear wall 12 of the main body 1. On the rear wall 12, a bracket 9 is attached corresponding to the button 4 placed in the recessed part 10*a* (described later), and the movable body 30 and the switching device 5 are incorporated by the bracket 9.

The cover bodies 2A and 2B open and close the upper opening (partitioned by the frame of the border member 10) of the main body 1 separately on the left and right sides, and they respectively have supporting arm parts 20 and 21 or 22 and 23 on the front and rear parts in the longitudinal direction. The front and rear arm parts 20 and 21 or 22 and 23 are pivotally supported on shafts 24 such as pins on the corresponding front and rear walls 11 and 12 of the main body 1. The cover bodies 2A and 2B are switched to rotate between the closed position and the open position with the shafts 24 as fulcra. On the front and rear arm parts 20 and 21 of the cover body 2A and the front arm part 22 of the cover body 2B, tooth shapes, that is, gear parts 25 or 26, are formed continuing on the arc-shaped perimeter part centered on the shaft 24. Such a gear part is not provided on the rear arm part 23 of the cover body 2B.

The cover bodies 2A and 2B, after respectively being pivotally supported by the shafts 24 on the main body 1, are linked with the coil spring 3, power transmitting device 7, and damper device 8 on the side of the front wall 11 of the main body 1, and they are linked with the operation button 4, switching device 5, and latch 6 on the side of the rear wall 12 of the main body 1.

Figure 2A:
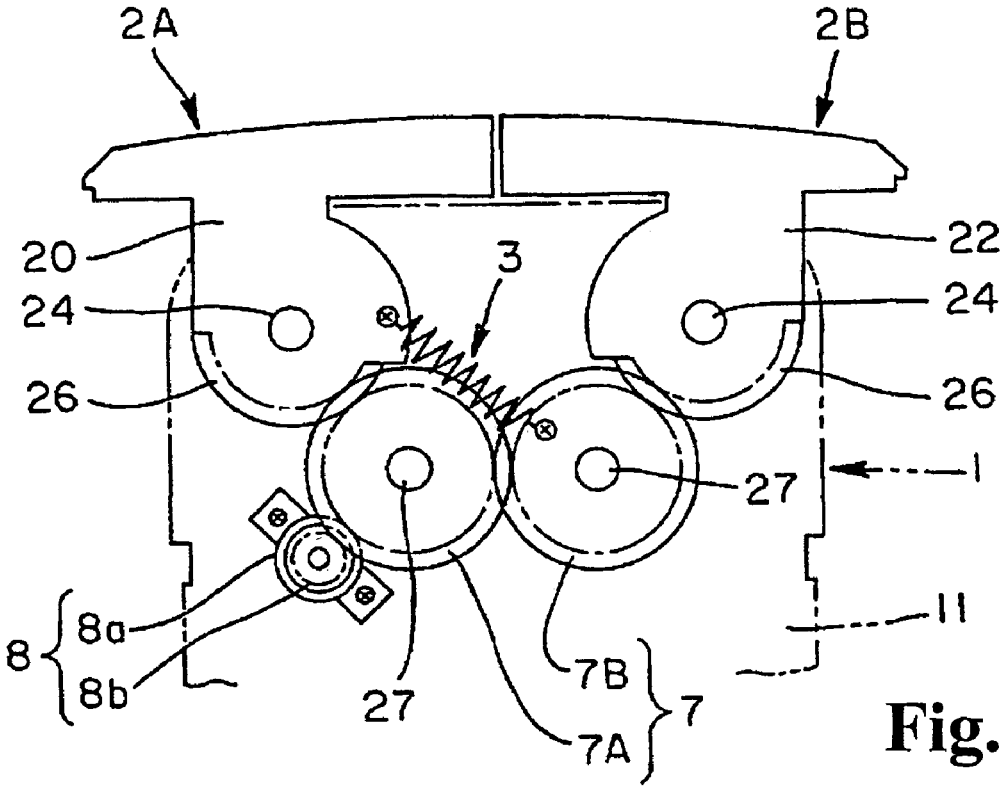
FIGS. 2(*a*) and 2(*b*) are schematic views showing the cover opening and closing device in FIGS. 1(*a*) and 1(*b*) viewed from the other side.
Figure 2B:
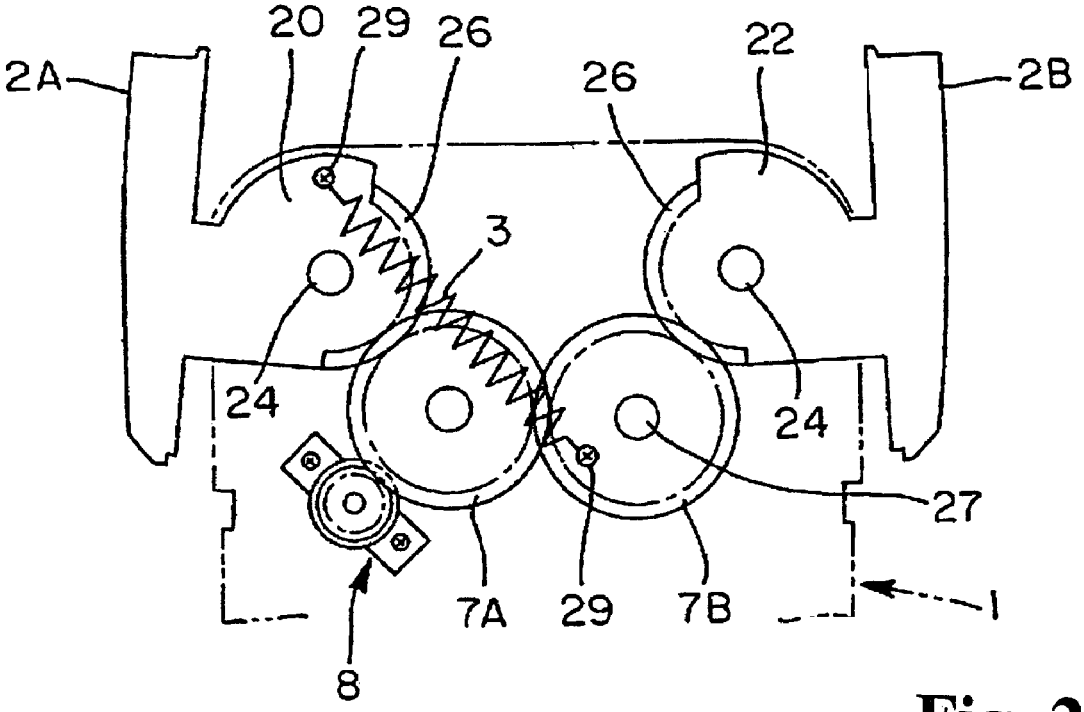
Figure 3A:
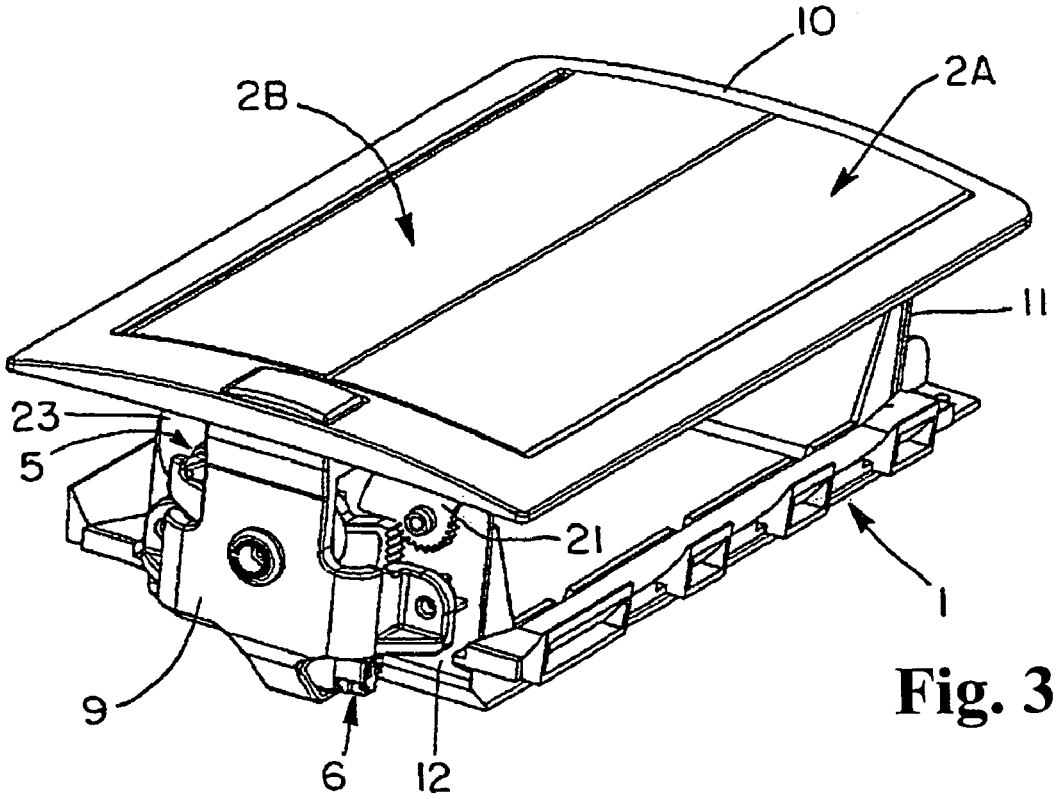
FIGS. 3(*a*) and 3(*b*) are views showing essential components of an apparatus having the cover opening and closing device.
Figure 3B:
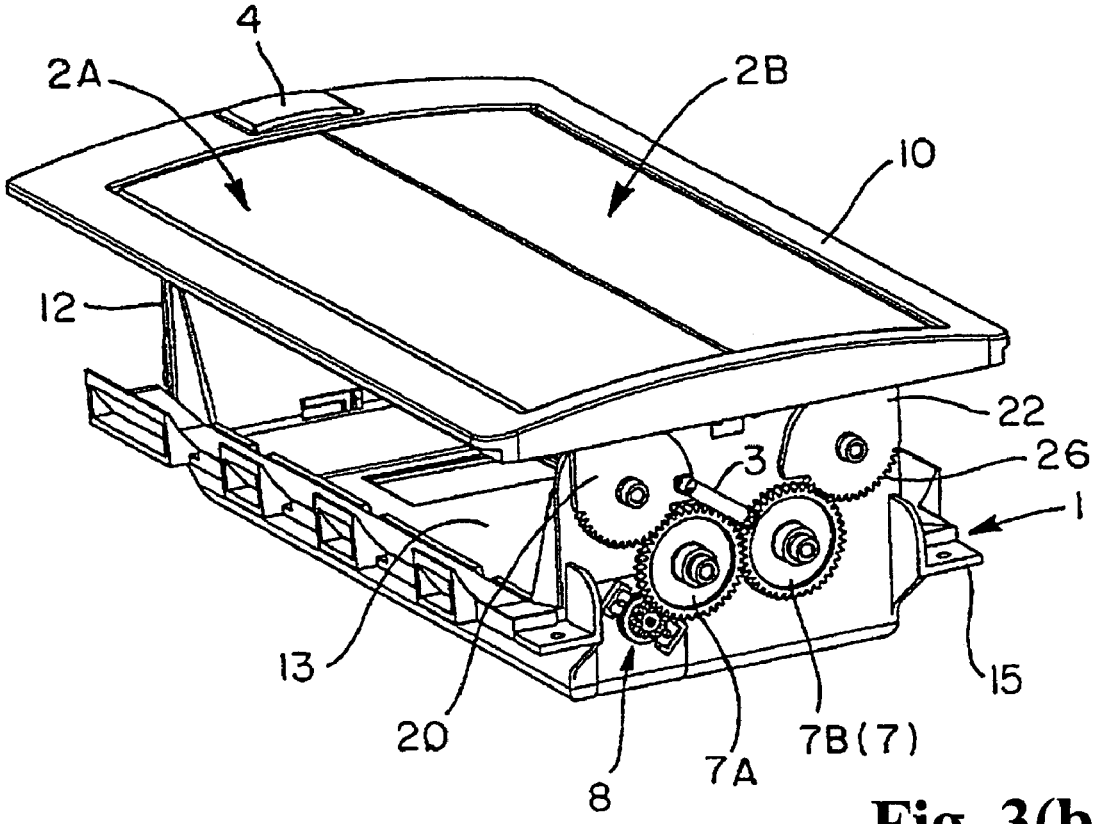
Figure 4:
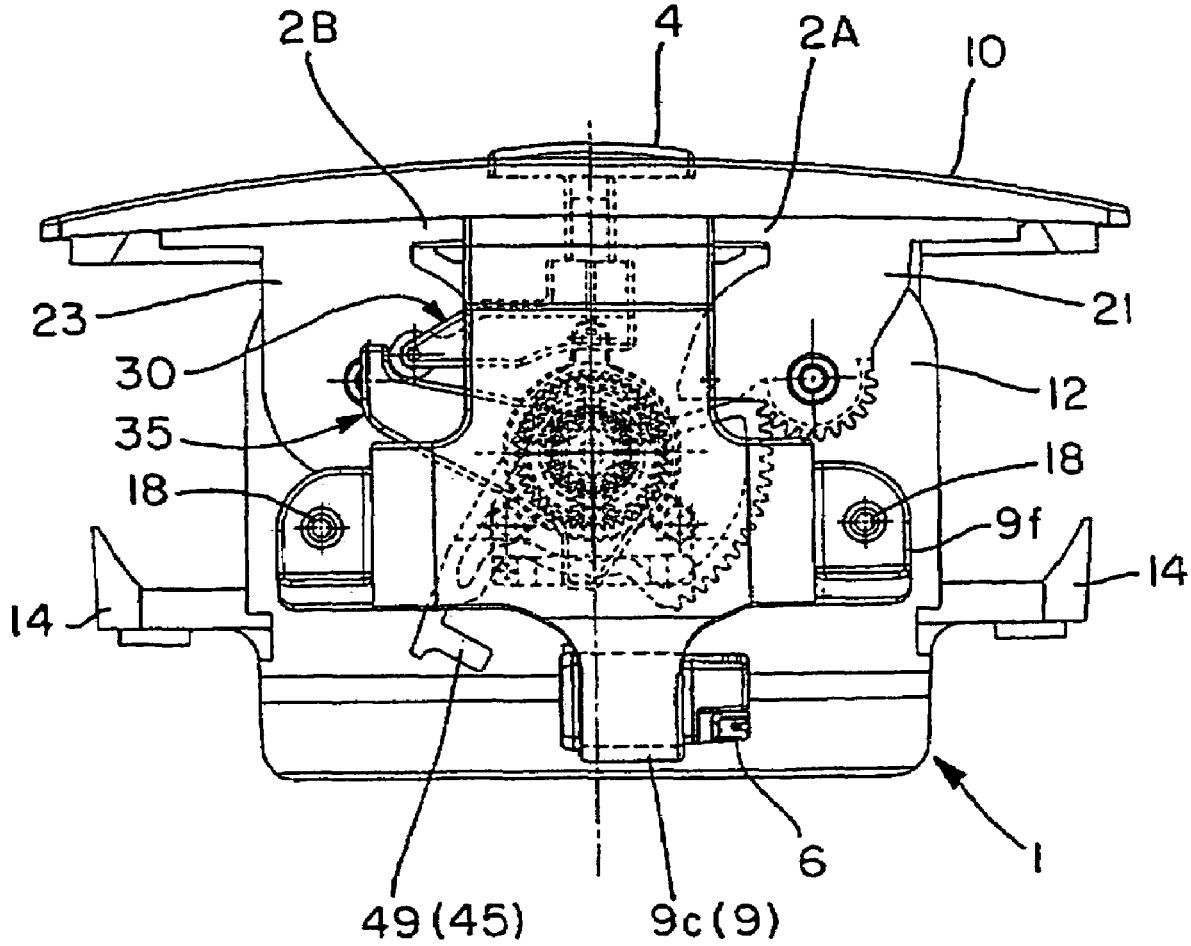
FIG. 4 is a rear view of the apparatus viewed from one side in the front-to-back direction.

The power transmitting device 7, as shown in FIGS. 2(*a*) and 2(*b*) and FIG. 3(*b*), comprises two mutually engaging idle gears 7A and 7B positioned on the front wall 11 of the main body 1 and respectively being pivotally supported by the shafts 27 between the front arm part 20 of the cover body 2A and the front arm part 22 of the cover body 2B. The idle gears 7A and 7B have gear shapes which engage the corresponding gear parts 26. In the embodiment, the gear part 26 of the front arm part 20 of the cover body 2A engages the idle gear 7A, and the gear part 26 of the front arm part 22 of the cover body 2B engages the idle gear 7B. Therefore, with the power transmitting device 7, when the cover body 2A is rotated toward the direction of the open position with the shaft 24 as a fulcrum, by each engagements previously noted, the cover body 2B is rotated toward the direction of the open position in synchronization with the cover body 2A with the shaft 24 as a fulcrum.

The coil spring 3 normally forces the cover body 2A toward the direction of the closed position, and one end side is fixed to the arm part 20 of the cover body 2A with a screw 29, and the other end side is fixed to the idle gear 7B engaged with the cover body 2B with a screw 29. In the single cover mode in FIGS. 8(*a*) and 8(*b*), one end side of the coil spring 3 is fixed to the arm part 20 of the cover body 2 with a screw 29, and the other end side is fixed to the corresponding part of the main body 1 with a screw 29. In the divided cover mode, as is clear from a comparison between FIGS. 2(*a*) and 2(*b*) and FIGS. 8(*a*) and 8(*b*), even if it is a coil spring having the same force, because the other end side is changed in position by the idle gear 7B, the spring pressure or force can be adjusted in a multifaceted manner.

The damper device 8 is formed of a rotary-type oil damper, or the like, and it has an output shaft which is subject to resistance of a working fluid such as oil filled inside a main body 8*a*, and a rotating gear 8*b* which is installed on that output shaft. The damper device 8 damps the rotational speed of the cover body 2A and prevents rapid rotation of the cover body 2A, with the rotating gear 8*b* engaging the idle gear 7A in a state in which the main body 8*a* is installed on the front wall 11 of the main body 1. In this case, the cover body 2B is damped by the idle gear 7B engaging the idle gear 7A. In the single cover mode in FIGS. 8(*a*) and 8(*b*), the rotating gear 8*b* of the damper device 8 engages the gear part 26 of the arm part 20 of the cover body 2.

Figure 5:
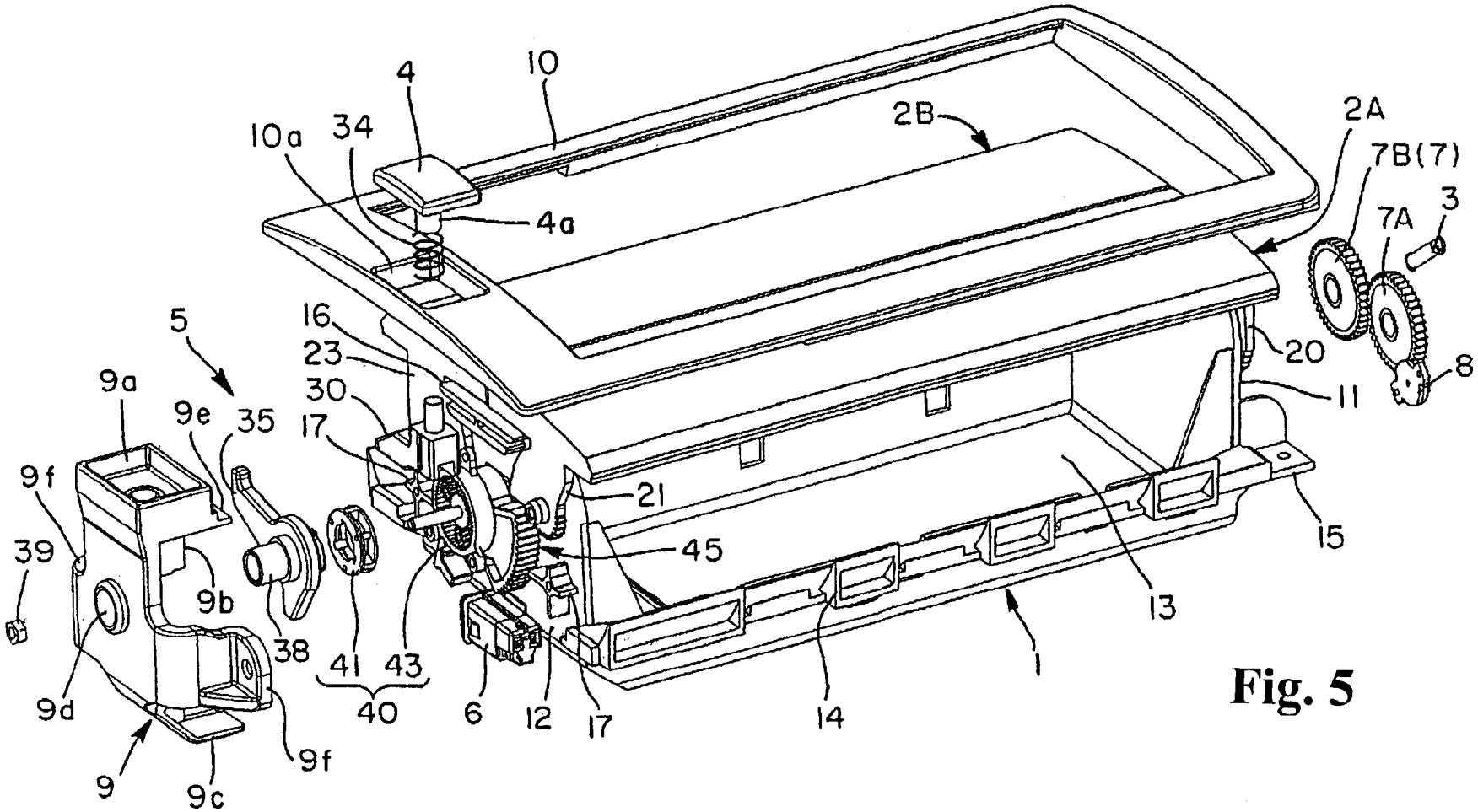
FIG. 5 is an exploded view showing the cover opening and closing device applied to the apparatus.

The operation button 4 is placed in the recessed part 10*a* of the border member 10, and the switching device 5 and the latch 6 are placed using the bracket 9 provided on the rear wall 12 of the main body. The button 4, as shown in FIG. 5 and FIGS. 6(*a*) and 6(*b*), has a roughly rectangular plate shape and a cylindrical part 4*a* protruding on the lower surface, and is linked to slide freely on the movable body 30 by the cylindrical part 4*a*. The movable body 30 is roughly L shaped, and has a shaft 31*a* protruding on the upper surface of a vertical part 31, and a roller 33*b* attached to rotate freely by a pin 33*a* on the front end of a horizontal part 32. The movable body 30 is linked to the button 4 in a state in which the shaft 31*a* is inserted inside the cylindrical part 4*a*. In this case, the button 4 is normally forced up to a fixed height on the movable body 30 by a spring member 34 placed around the cylindrical part 4*a*. In other words, the upper end of the spring member 34 is fixed on the side of the cylindrical part 4*a*, and the lower end is fixed on the side of the shaft 31*a* or the vertical part 31. After the button 4 is pushed down with a finger and the finger is released, the button 4 is returned by force to the original height position.

The bracket 9, as shown in FIG. 5, has an integrally formed recessed receiving part 9*a* which overlaps with the recessed part 10*a* provided on the upper side of the main body for placing the operation button 4; a frame part 9*b* which is provided beneath the recess of the receiving part 9*a* for guiding the vertical part 31 of the movable body 30 inserted therein to slide freely; a latch holding part 9*c* which is provided beneath the main body; a hole part 9*d* for cylinder support which is provided in the middle part of the main body; and tab parts 9*e* and 9*f* protruding on the front surface of the receiving part 9*a* on both sides of the main body. The bracket 9 is installed on the rear wall 12 of the main body by coupling the tab part 9*e* to the attachment part 16 of the main body 1 for fixing the corresponding tab parts 9*f* to the attachment parts 17 of the main body 1 by screws 18 or the like.

During the installation, the movable body 30 is placed in a state in which the vertical part 31 is inserted into the frame part 9*b*, and the latch 6 is attached and held on the holding part 9*c*. After that, the shaft 50 is passed through the pass-through hole of the rear wall 12 from inside the main body 1 and is made to stick outwardly. The shaft 50, as shown in FIGS. 6(*a*) and 6(*b*), is pivotally supported in a state sequentially running through the acceleration gear 45, gear mechanism 40, and cam 35 constituting the switching device 5 on the shaft axis. A front end thereof (not illustrated, formed as a male screw) is inserted in a cylindrical part 38 of the cam 35 (described later), and the front end is coupled to a nut 39 inside the cylindrical part 38 to prevent slipping off. Symbol 50*a* is a flange part or head part on the base of the shaft.

The switching device 5, as shown in FIG. 6(*b*), is constituted such that the cam 35 rotates toward the direction of the arrow by the movable body 30 by the pushing force of the button 4, and the acceleration gear 45 rotates toward the direction of the arrow in linkage with the rotation of the cam 35. In this example, the gear mechanism 40 is interposed between the cam 35 and the acceleration gear 45, so that the pushing force of the button 4 does not become excessively great.

The cam 35 has an integrally formed main body 36 which has formed a shaft hole for inserting a shaft therethrough, and a comparatively long arm part 37 protruding toward one side of the main body 36. On the inner surface 36*a* of the main body 36, a linkage part (not illustrated) is provided, and a holder 41 is directly connected with the linkage part. On the outer surface 36*b*, a cylindrical part 38 for inserting a nut 39 is protruding. The cylindrical part 38 is supported in a state being inserted into the hole part 9*d* of the bracket 9. The front end 37*a* of the arm part 37 is bent upwardly, and the upper surface extending from the front of that front end 37*a* to the main body 36 is set on a pressing surface 37*b* which contacts the roller 33*b* of the movable body 30.

The acceleration gear 45 has an integrally formed main body 46 in which a shaft hole is formed and a gear part 47 which is formed on a part of the main body 46. On the outer surface side of the main body 46, a flat gear 48 is fixed coaxially with the shaft hole. The gear part 47 has a tooth shape which engages the gear part 25 of the cover body 2A or the cover body 2. The gear part 47 is provided on a tongue-shaped part protruding by a prescribed measurement from the main body 46. When the main body 46 is pivotally supported on the shaft 50 and is rotated by the cam 35, the acceleration gear 45 accelerates the rotational speed of the gear part 47 over the gear part 25 by the amount that it is moved away from the shaft hole or the shaft 50.

The gear mechanism 40 is constituted by a holder 41 having plural small gears (pinions) 42 pivotally supported on a concentric circle; an inner gear 43 inserting the holder 41 on the inner diameter and having formed inner teeth 44 for engaging each small gear 42; and a flat gear 48 which is provided on the side of the acceleration gear 45. The holder 41 is roughly donut shaped, and the plural small gears 42 are assembled in equally spaced locations on the perimeter. Each small gear 42 protrudes outwardly somewhat from the outer diameter and inner diameter of the holder 41 in that assembled state. When the holder 41 is placed into the inner diameter of the inner gear 43 from a state being linked to the inner surface 36*a* of the cam 35, each small gear 42 engages the inner teeth 44 of the inner gear 43. When the flat gear 48 fixed to the acceleration gear 45 is inserted into the holder 41 from the inner diameter of the inner gear 43, each small gear 42 engages the flat gear 48.

(Operation)

An operation of the cover opening and closing device will be explained with reference to FIGS. 1(*a*) and 1(*b*) and FIGS. 2(*a*) and 2(*b*). Each of FIG. 1(*a*) and FIG. 2(*a*) shows the closed position of the cover bodies. In the closed position, the cover bodies 2A and 2B are held by a strength corresponding to the spring pressure of the coil spring 3 provided between the arm part 20 of the cover body 2A and the idle gear 27 engaging with the gear part 26 of the cover body 2B. The button 4 is in an upper initial position by the force of the spring member 34, and the roller. 33 of the movable body 30 is lightly in contact with the pressing surface 37*b* of the cam 35. In switching the cover bodies 2A and 2B to the open position, the button 4 is pressed toward the direction of the arrow in FIG. 1(*a*) by a finger, or the like. Accordingly, the movable body 30 is moved toward the pushing direction of the button 4. The cam 35 is rotated counterclockwise by the roller 33 by the movement of the movable body 30. When the cam 35 is rotated, the acceleration gear 45 is rotated toward the same direction as the cam 35 by the gear mechanism 40. The cover body 2A, by the rotation of the acceleration gear 45, is rotated up to the open position shown in each of FIG. 1(*b*) and FIG. 2(*b*) by the engagement between the gear part 47 and the gear part 25. In the course of the rotation, the force of the coil spring 3 is increased, that is, the spring is charged. The rotational force of the cover body 2A is transmitted to the other cover body 2B by the power transmitting device 7, so that the cover body 2B can be rotated up to the open position in synchronization. At the same time, the catching claw 49 is caught (locked) on the latch 6 pursuant to the rotation of the acceleration gear 45. Accordingly, the cover bodies 2A and 2B are held in the open position in opposition to the force of the coil spring 3.

In switching the cover bodies 2A and 2B to the closed position, the button 4 is pushed toward the direction of the arrow in FIG. 1(*b*), that is, the same direction as when putting into the open position, and then the pushing force is released. Accordingly, the cover bodies 2A and 2B move from the position of the solid line in the drawing to the position of the hidden line by the movable body 30, the cam 35, the gear mechanism 40, and the acceleration gear 45 by the pushing force. The catching claw 49 is released from the caught state in a state having once deeply entered into the housing of the latch 6. Then (after releasing the pushing force), the cover bodies 2A and 2B are again switched to rotate toward the closed position by the force of the coil spring 3 as described previously.

MODIFIED EXAMPLE 1

Figure 7A:
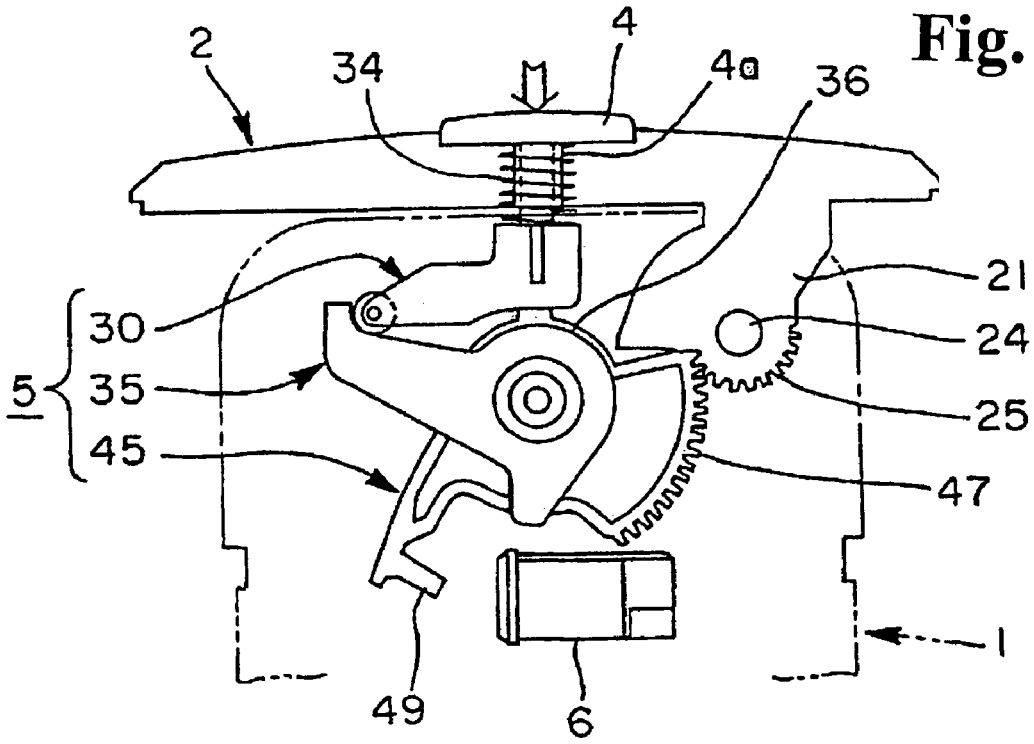
FIGS. 7(*a*) and 7(*b*) are schematic views showing a cover opening and closing device applied to a single cover body corresponding to FIGS. 1(*a*) and 1(*b*) according to a modified example of the first embodiment.
Figure 7B:
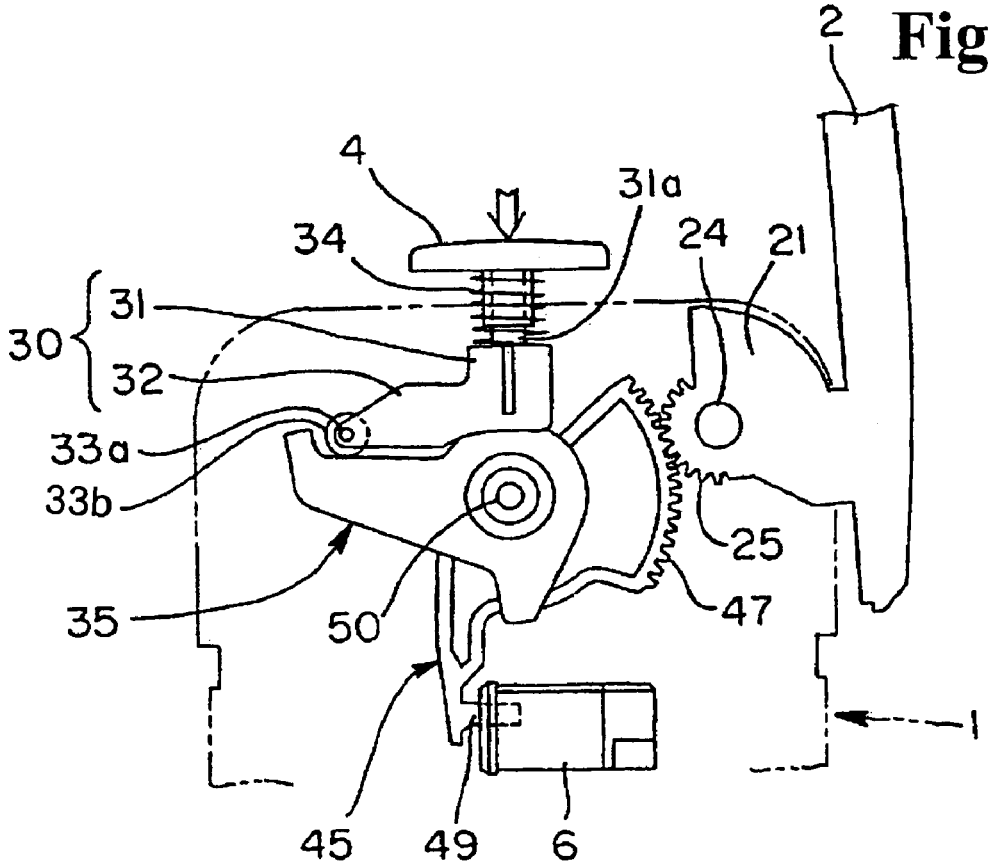
Figure 8A:
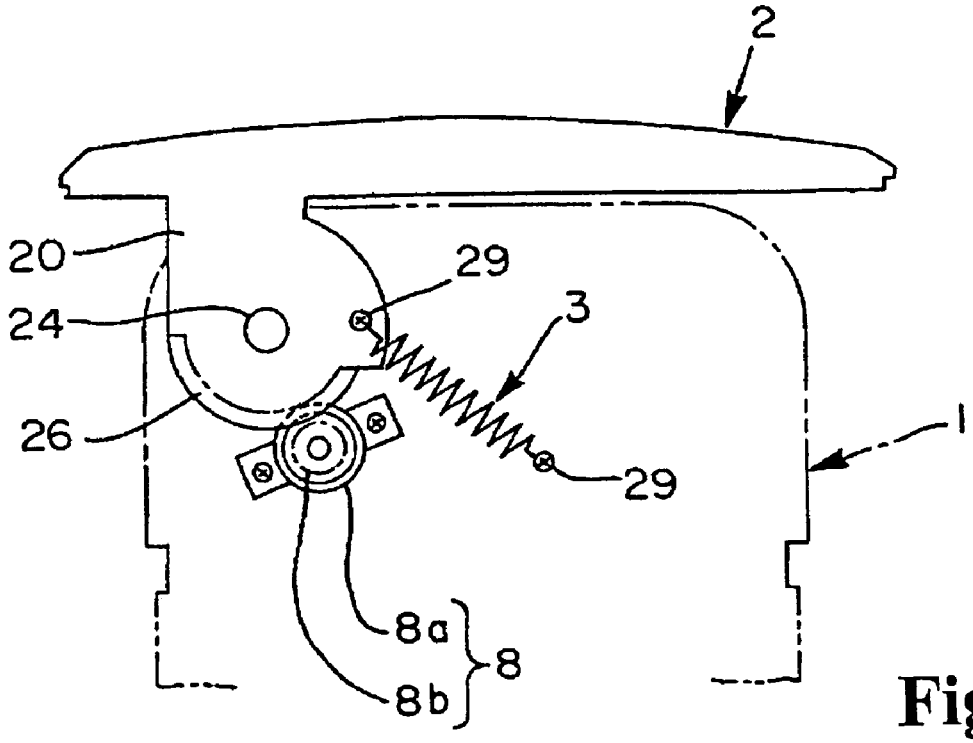
FIGS. 8(*a*) and 8(*b*) are schematic views showing the cover opening and closing device corresponding to FIGS. 2(*a*) and 2(*b*) according to the modified-example.
Figure 8B:
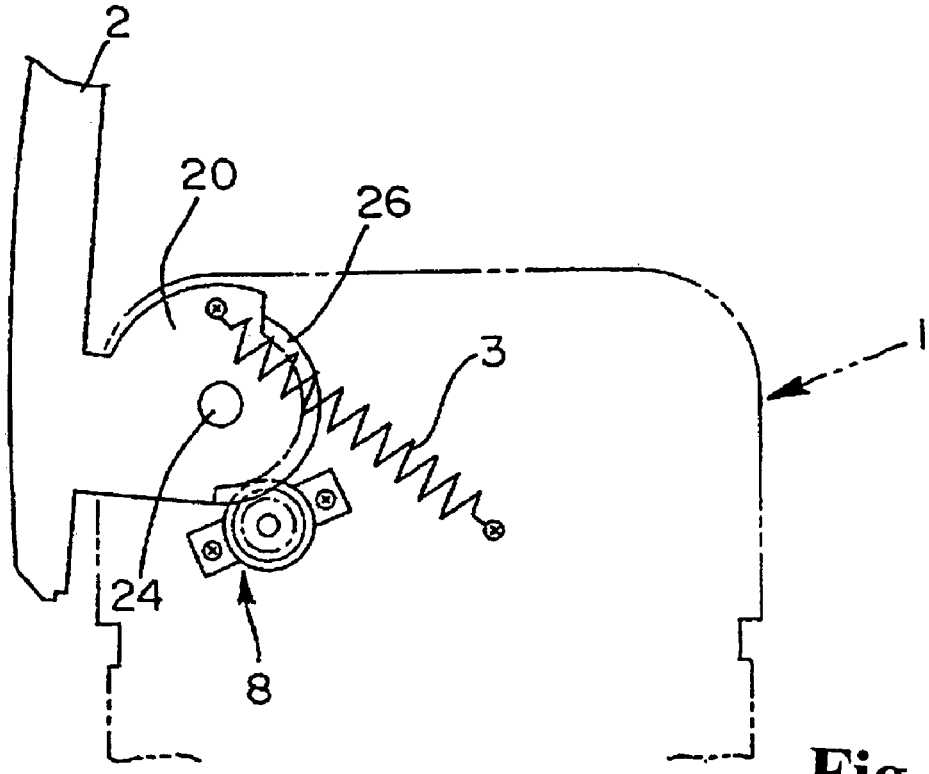
Figure 9:
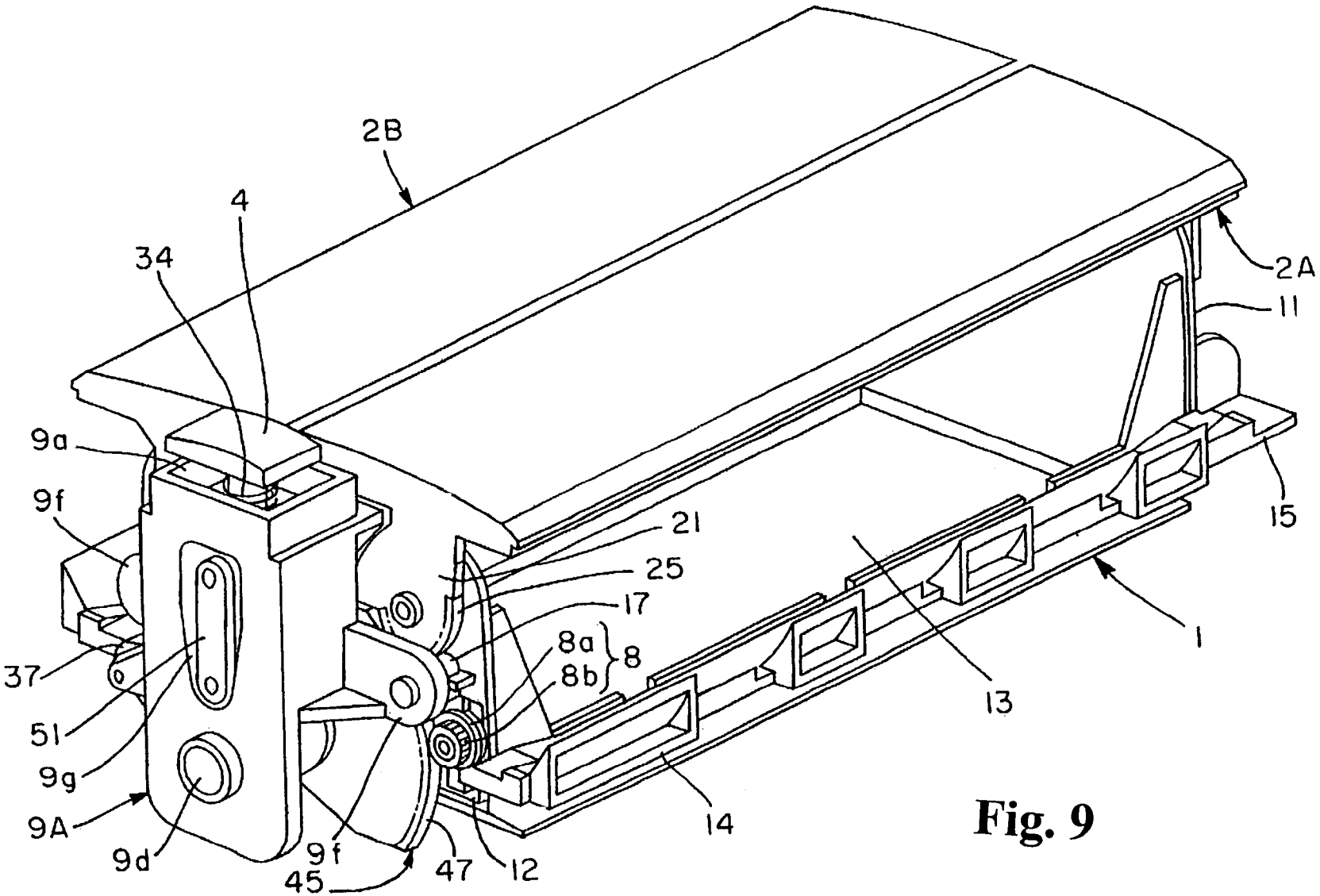
FIG. 9 is a view showing an apparatus having the cover opening and closing device with an engaging device different from that in the first embodiment corresponding to FIG. 3(*a*) according to another modified example of the first embodiment.

The modified example shown in FIGS. 7(*a*) and 7(*b*) and FIGS. 8(*a*) and 8(*b*) switches one cover body 2 to rotate between the closed position and the open position using the cover opening and closing device. The structure comprises as constituent members: a coil spring 3 as a forcing device which normally forces the cover body 2 pivotally supported on the main body 1 toward the direction of the closed position; a single push operation button 4 which is provided on the main body 1 or a border member 10 for the main body; a switching device 5 which has a cam 35 placed opposite to the button 4 and an acceleration gear 45 being linked to the cam 35 and engaging a gear part 25 provided on the cover body 2 and a catching claw 49 provided on the acceleration gear 45, and switches the cover body 2 from the closed position to the open position in opposition to the force of the coil spring 3 by the cam 35 and the acceleration gear 45 by the push operation of the button 4; and a latch 6 which catches the catching claw 49 in the open position of the cover body 2 and enables release of the catching by the push operation of the button 4.

Accordingly, the cover body 2 is forced to be held in the closed position (or closed state) by a strength corresponding to the spring pressure of the coil spring 3 as shown in FIGS. 7(*a*) and 8(*a*). In switching the cover body 2 to the open position (or open state), when the button 4 is pushed, the cover body 2 is rotated in opposition to the force of the coil spring 3 by the switching device 5 up to the open position in which the opening of the main body 1 is almost completely open as shown in FIGS. 7(*b*) and 8(*b*). At the same time, the catching claw 49 is caught (locked) on the latch 6 attached on the side of the main body 1 pursuant to the movement of the acceleration gear 45. Accordingly, the cover body 2 is held in the open position in opposition to the force of the coil spring 3. The holding is released when the button 4 is pushed in the same direction and the pushing force is released. By the release, the cover body 2 is again switched to rotate to the open position by the force of the coil spring 3. The single cover mode described above is applied analogously in the same manner to a modified example 2 and a second embodiment described next.

In the first embodiment and modified example 1, the switching device 5 may be formed of just the cam 35 and the acceleration gear 45. By interposing the gear mechanism 40 between the cam 35 and the acceleration gear 45, the pushing load applied to the button can be reduced and the operability can be improved, for example, when switching the cover body from the closed position to the open position by push operation of the button 4.

MODIFIED EXAMPLE 2

When the latch 6 which catches and releases the catching claw 49 is a push-push catching mechanism, as shown in FIG. 1(*b*), the cover body moves slightly toward the open direction when the holding of the catching claw 49 is released by the push operation of the button 4. The modified example shown in FIG. 9 to FIGS. 14(*a*) and 14(*b*) eliminates such a slight movement of the cover. Structurally, a bracket 9A (corresponding to the bracket 9) has an arm 51 and a trace pin 53 protruding on the free end of the arm 51. Inside the vertical part 31 of the movable body 30, a sliding body 55 in which a cam groove 56 is formed; a frame member 57 which is built into the vertical part 31 in a state of retaining the sliding body 55; a lock member 59 which is built in below inside the frame 57; a coil spring 58*a* which forces the frame member 57 upwardly; and a coil spring 58*b* which forces the lock member 59 toward the direction of protruding from the frame member 57 are built in. They are features different from those in the first embodiment.

The placement of the damper device 8 is changed. In the example, the main body 8*a* is attached on the rear wall 12 of the main body, and the rotating gear 8*b* engages the gear part 47 of the acceleration gear 45. Thus, the damper device 8 can be placed in various locations. In the modified example, different from the first embodiment, the acceleration gear 45 does not have the catching claw 49; the cam 35 and the holder 41 of the gear mechanism 40 are formed as an integrated product; the cam 35 does not have the front end 37*a* oriented upwardly; and an attachment hole is formed on the front side of the arm part 37, but operationally it is the same.

The bracket 9A has a recessed part 9*g* at roughly the center part of the side wall, and a pass-through hole is formed in the upper part of that recessed part 9*g*. In the recessed part 9*g*, the arm 51 is attached to be rotatable by a coupling part (complementary shape coupling between the members) 52 on the lower side. The arm 51 is rocked in the left-to-right direction inside the recessed part 9*g* with the coupling part 52 as a fulcrum. On the free end of the arm 51, the trace pin 53 is projecting inwardly by an attachment member 54. On the inner surface of the wall on which the recessed part 9*g* is formed, there are provided a projecting part 9*j* projecting out in a downward sloping state as in FIG. 12, and a recessed part 9*h* which is provided beneath the projecting part 9*j*.

Figure 10:
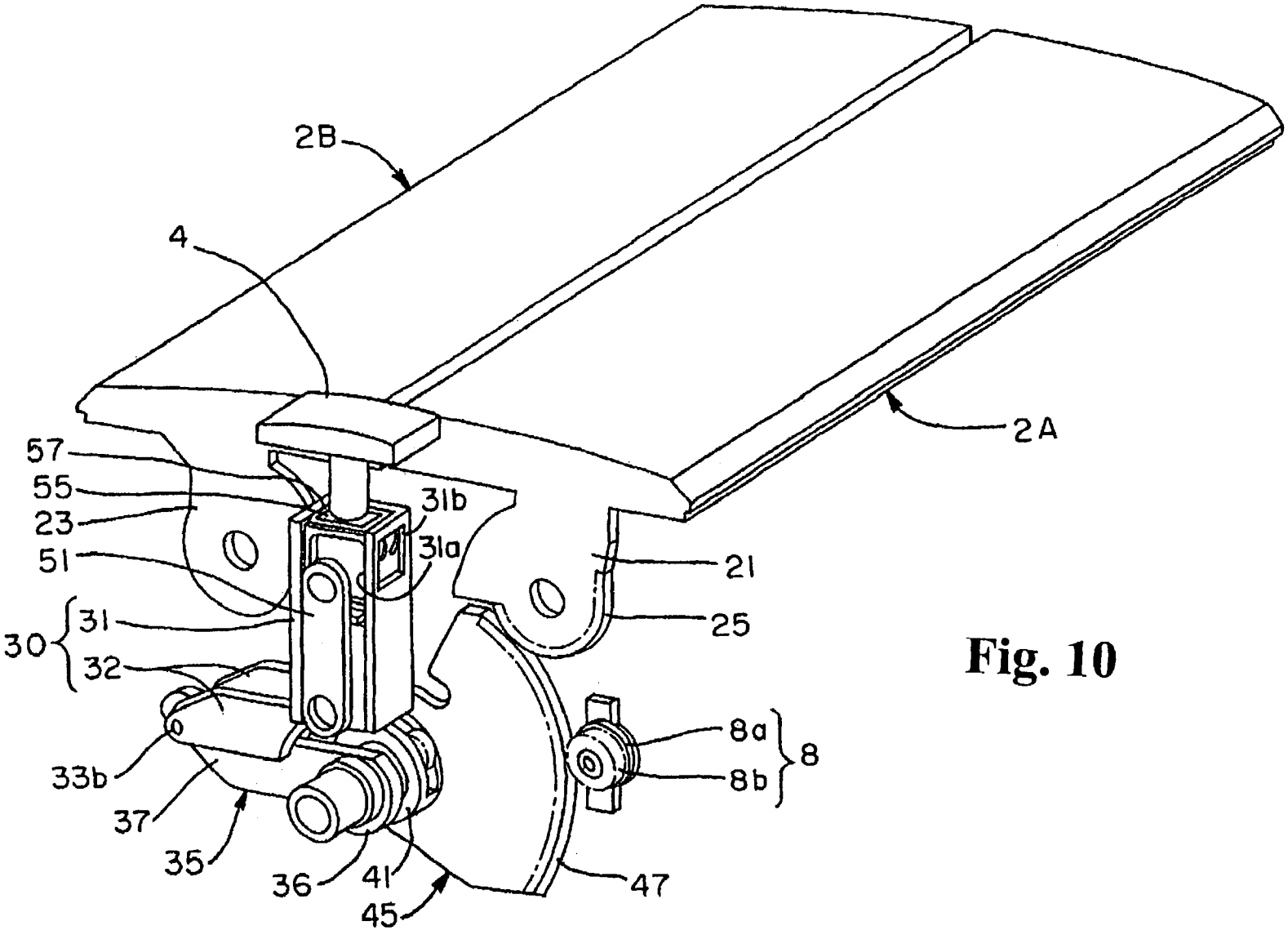
FIG. 10 is a view showing a positional relationship of main members of the engaging device in FIG. 9.
Figure 11:
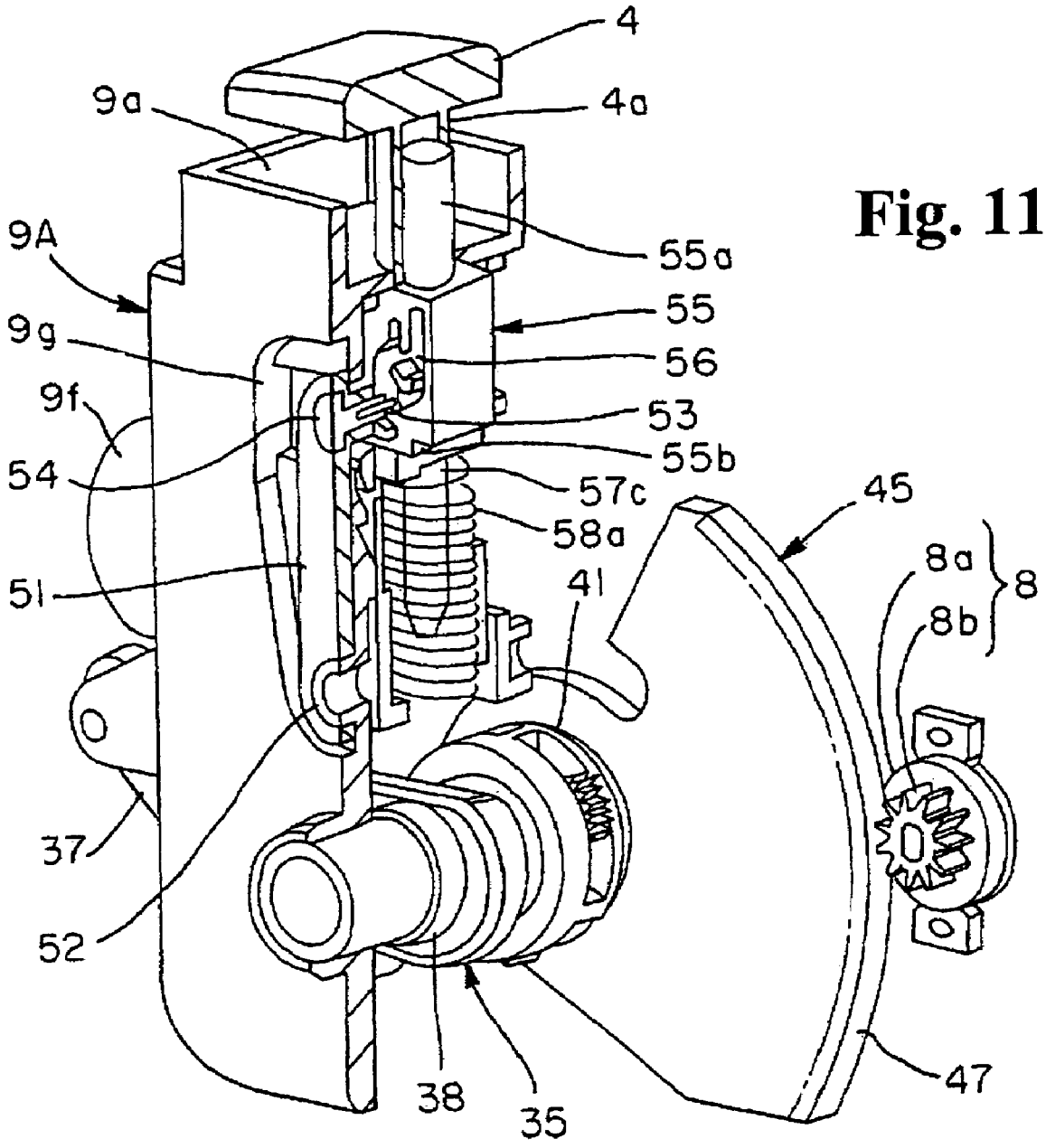
FIG. 11 is a partial sectional view showing a switching device and the engaging device in FIG. 9.

The movable body 30 is formed of the vertical part 31 and the horizontal part 32 as in the first embodiment, and the vertical part 31 is formed longer and hollow inside. That is, the vertical part 31 is lacking a part of the front and back surfaces and a part of the left and right surfaces as in FIG. 10. In FIG. 10, symbol 31*a* is a comparatively large opening in the front side, and symbol 31*b* is a comparatively small opening placed oppositely in the left and the right.

Figure 12:
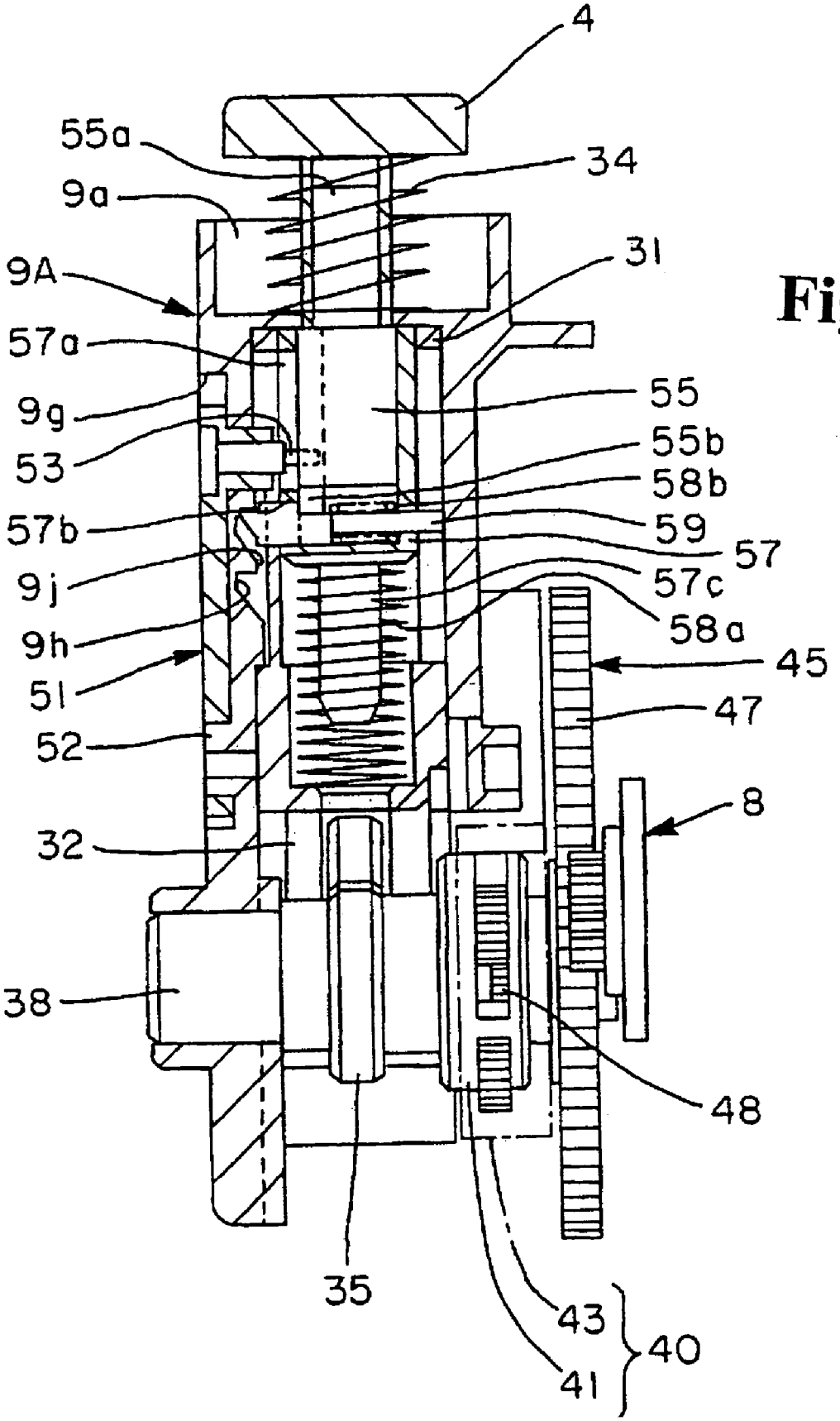
FIG. 12 is a partial sectional view showing the switching device and the engaging device in FIG. 9.
Figure 14A:
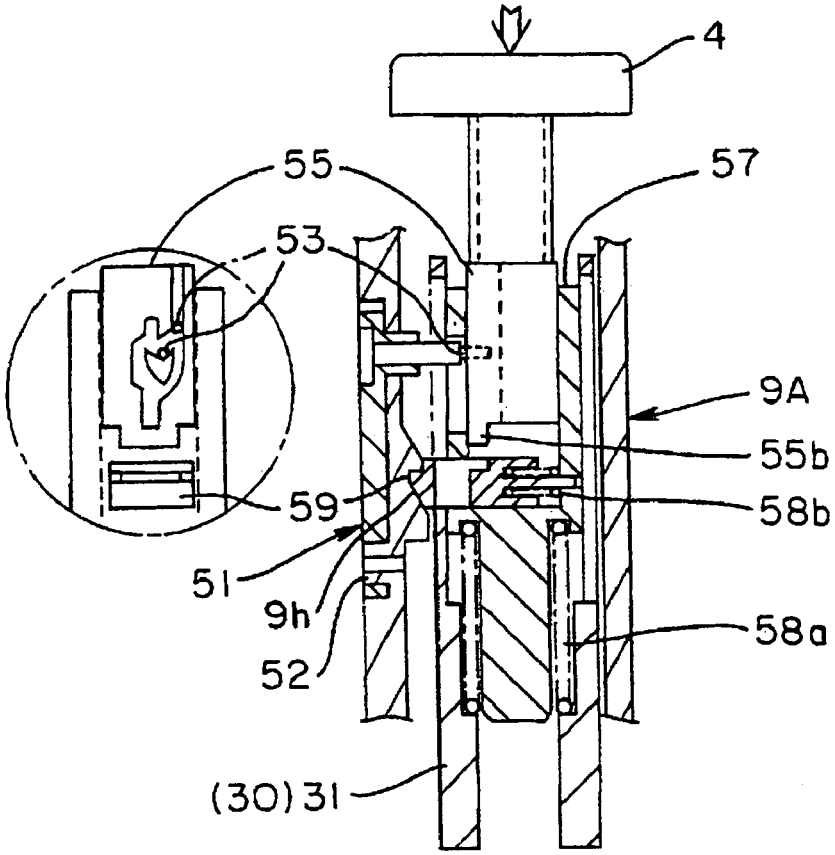
FIGS. 14(*a*) and 14(*b*) are sectional views of the essential components of the engaging device in FIG. 9 similar to FIGS. 13(*a*) and 13(*b*)
Figure 14B:
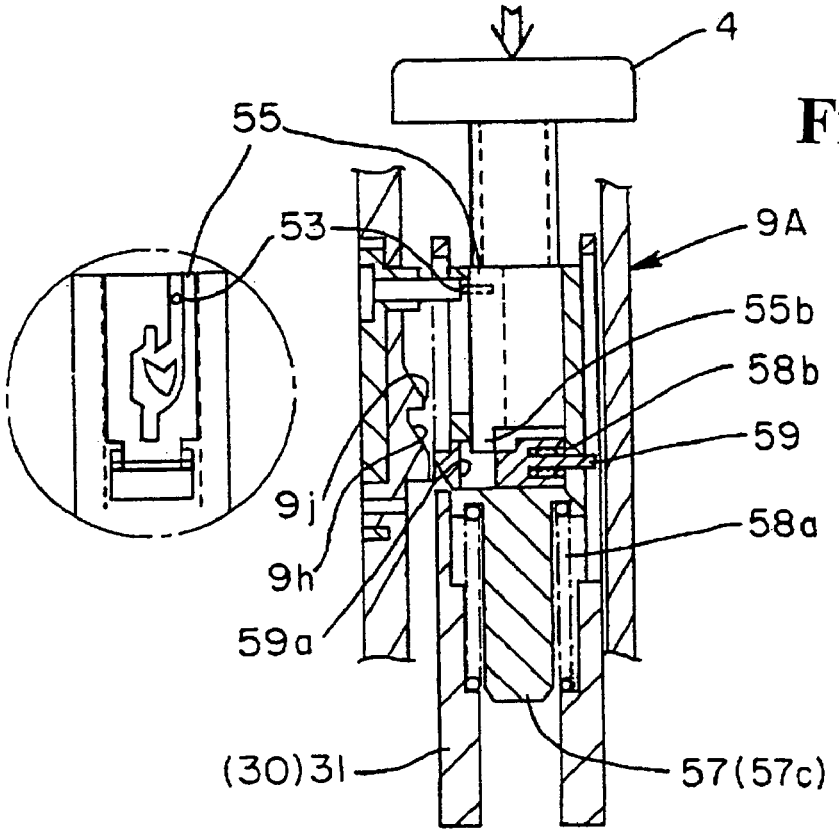

The frame member 57 is opened on the top, and the surface corresponding to the opening 31*a* has formed openings in two stages, that is, an upper large hole 57*a* and a small hole 57*b* beneath that as in FIG. 12. The frame member 57 has a guide shaft 57*c* projecting downwardly from the bottom surface and elastic claws provided on both side surfaces. Inside the frame member 57, the lock member 59 is inserted and placed from the small hole 57*b* together with the coil spring 58*b*. As shown in FIGS. 14(*a*) and 14(*b*), the lock member 59 has a claw part on the front surface, a hole 59*a* passing through vertically behind the claw part, and a shaft part supporting the coil spring 58*b* projecting out backward on the back side. When the lock member 59 is placed inside the frame member 57 from the small hole 57*b*, it becomes in the normal state in which the front end claw part and the hole 59*a* are positioned outside the frame part 57. When it is subjected to stress from the front backward, it is moved horizontally in opposition to the force of the coil spring 58*b* until the hole 59*a* enters the frame member 57. When the frame member 57 is inserted inside the vertical part 31 together with the coil spring 58*a* supported on the guide shaft 57*c*, the elastic claw couples with the corresponding opening 31*b*. Therefore, although the frame member 57 is moved up to the maximum by the force of the coil spring 58*a* in the normal state, it does not come out from the vertical part 31 because of the elastic claw.

The sliding body 55 has a small block shape held inside the frame member 57, and has a cam groove 56 formed in one surface, an integrally formed shaft part 55*a* protruding on the upper surface and inserted inside the cylindrical part 4*a* of the button 4, and an integrally formed projection 55*b* projecting out on the front edge part of the lower surface. The cam groove 56 has a generally raised heart shaped island as is typically shown inside the left circle in FIGS. 13(*a*) and 13(*b*) and FIGS. 14(*a*) and 14(*b*), and it has a guiding cam groove for coupling 56*a*, a coupling groove 56*b*, and a guiding cam groove for releasing 56*c*, and the like, provided following the perimeter of the island. Also, it has a stopper cam surface for coupling 56*d* in the uppermost position of the guiding cam groove for coupling 56*a*, and a guiding cam surface sloping diagonally downwardly from the cam surface 56*d*.

(Operation)

Figure 13A:
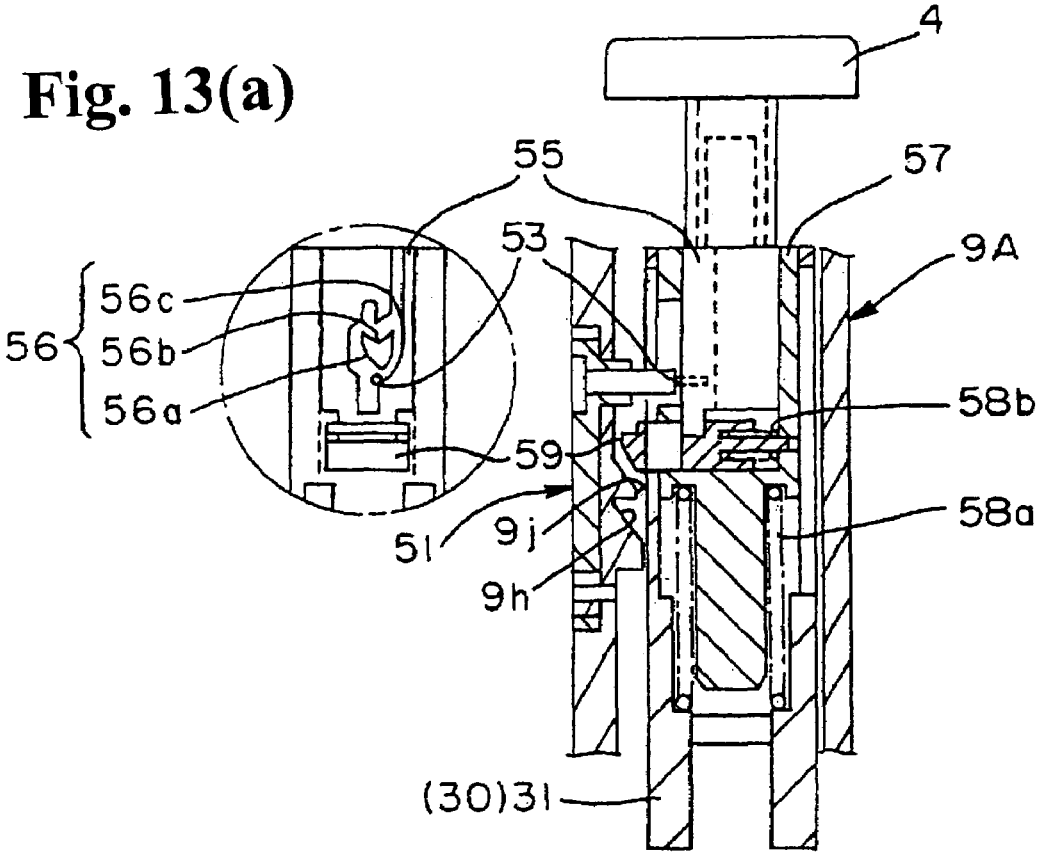
FIGS. 13(*a*) and 13(*b*) are sectional views of essential components of the engaging device in FIG. 9.
Figure 13B:
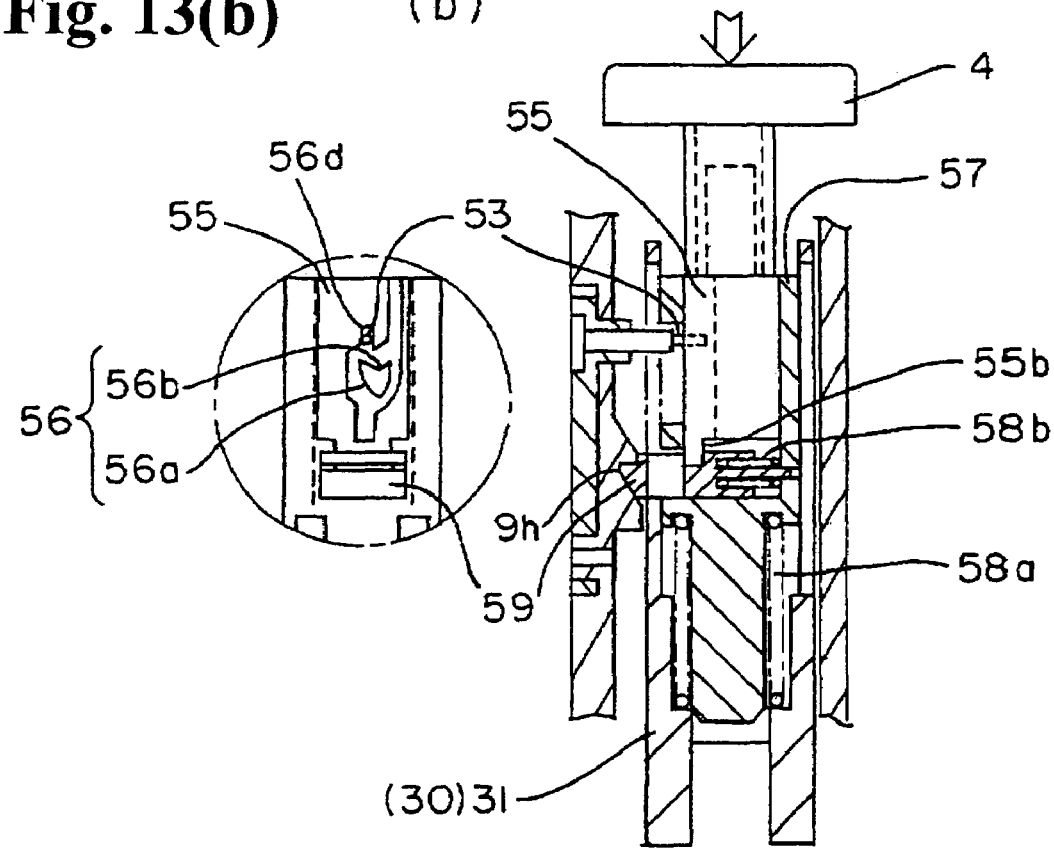

An operation of the modified example 2 will be explained with reference to FIGS. 13(*a*) and 13(*b*) and FIGS. 14(*a*) and 14(*b*). FIG. 13(*a*) shows the closed position of the cover bodies 2A and 2B, and in this state, the lock member 59 is positioned above the projecting part 9*j* on the side of the bracket 9A, and the trace pin 53 is positioned in the guiding cam groove for coupling 56*a* in the cam groove 56.

FIG. 13(*b*) shows the state in which the button 4 is pushed downwardly in order to switch the cover bodies 2A and 2B to the open position. When the button 4 is pushed, after the sliding body 55 contacts the lock member 59 through the projection 55*b*, the frame member 57 is moved downwardly in opposition to the force of the coil spring 58*a*. The downward movement is checked by the trace pin 53 contacting with the stopper cam 56*d* for coupling. In this process, the lock member 59 strikes the sloping surface of the projecting part 9*j*, and rides over the projecting part 9*j* while retreating in opposition to the force of the coil spring 58*b* by the recoil received from the sloping surface. The lock member 59 riding over the projecting part 9*j* is returned to the original protruding position by the force of the coil spring 58*b*, and is coupled into the recessed part 9*h*. In this structure, when the lock member 59 is coupled into the recessed part 9*h*, the vertical movement of the vertical part 31 (movable body 30) is checked and the cam 35 becomes incapable of rotating without relation to the engaging device constituted by the trace pin 53 and the cam groove 56. Also, when the finger or the like is removed from the button 4 and the pressing force on the lock member 59 is released, the sliding body 55 is slid upwardly by the force of the coil spring 34 (see FIG. 12) inside the receiving part 9*a* without relation to the vertical part 31 (movable body 30). At the same time, the trace pin 53 moves from the stopper cam surface 56*d* to the coupling groove 56*b* and couples.

FIG. 14(*a*) shows the initial stage in which the button 4 is pushed downwardly in order to switch the cover bodies 2A and 2B from the open position to the closed position. FIG. 14(*b*) shows the final stage. When the button 4 is pushed, the sliding body 55 is slid downwardly. After contacting the lock member 59 through the projection 55*b*, the lock member 59 is retracted by a prescribed amount in opposition to the force of the coil spring 58*b* by the recoil received from the downward sloping surface partitioning the recessed part 9*h*. In the final stage, the projection 55*b* couples in the hole 59*a* of the lock member 59. In this process, the trace pin 53 enters the guiding cam groove for releasing 56*c* from the coupling groove 56*b*, and slides toward above that guiding cam groove 56*c*. When the finger or the like is removed from the button 4 and the pressing force on the lock member 59 is released, the trace pin 53 is returned to the original position in FIG. 13(*a*) from above the guiding cam groove 56*c*. Also, the vertical part 31 (rotating body 30) moves up together with the lock member 59 and the frame member 57, and the cover bodies 2A and 2B are switched to rotate to the closed position through the cam 35. Accordingly, in the above modified example 2, the push-push catching mechanism is constituted by the cam groove 56 of the sliding body 55 and the trace pin 53. The problem in which the cover bodies 2A and 2B move slightly toward the open direction when the cover bodies are switched from the open position to the closed position as shown in FIG. 1(*b*) can be solved by interposing of the lock member 59, thereby eliminating incongruousness and improving convenience.

Second Embodiment

In the second embodiment shown in FIG. 15 to FIGS. 23(*a*) and 23(*b*), the switching device 5A (corresponding to the above switching device 5) for switching the cover bodies 2A and 2B between the closed position and the open position on the main body 1 and the latch or engaging device (push-push engaging device) in the first embodiment and each modified example mentioned above are replaced. In order to improve the operability of the button 4A (corresponding to the button 4), the cover bodies 2A and 2B are switched to rotate respectively between the closed position and the open position by just pushing the button 4 up to midway. Structurally, it comprises a coil spring 3A as a forcing device; an operation button 4A; a switching device 5A; a trace pin 78 and a cam groove 66 constituting a engaging device; a power transmitting device 7; and a damper device (not illustrated) similar to the damper device 8.

Figure 17:
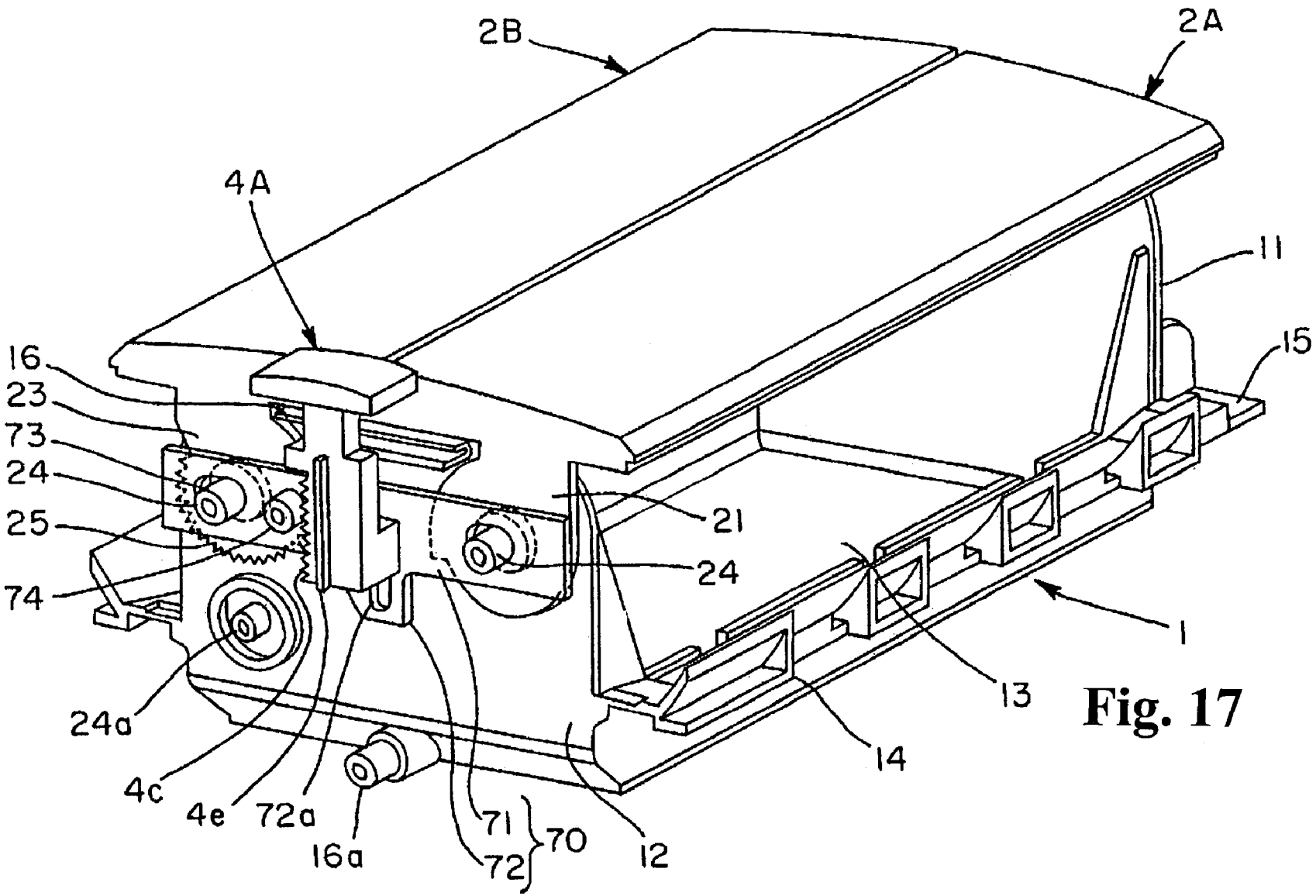
FIG. 17 is a simplified view showing the cover opening and closing device in FIG. 16.
Figure 21A:
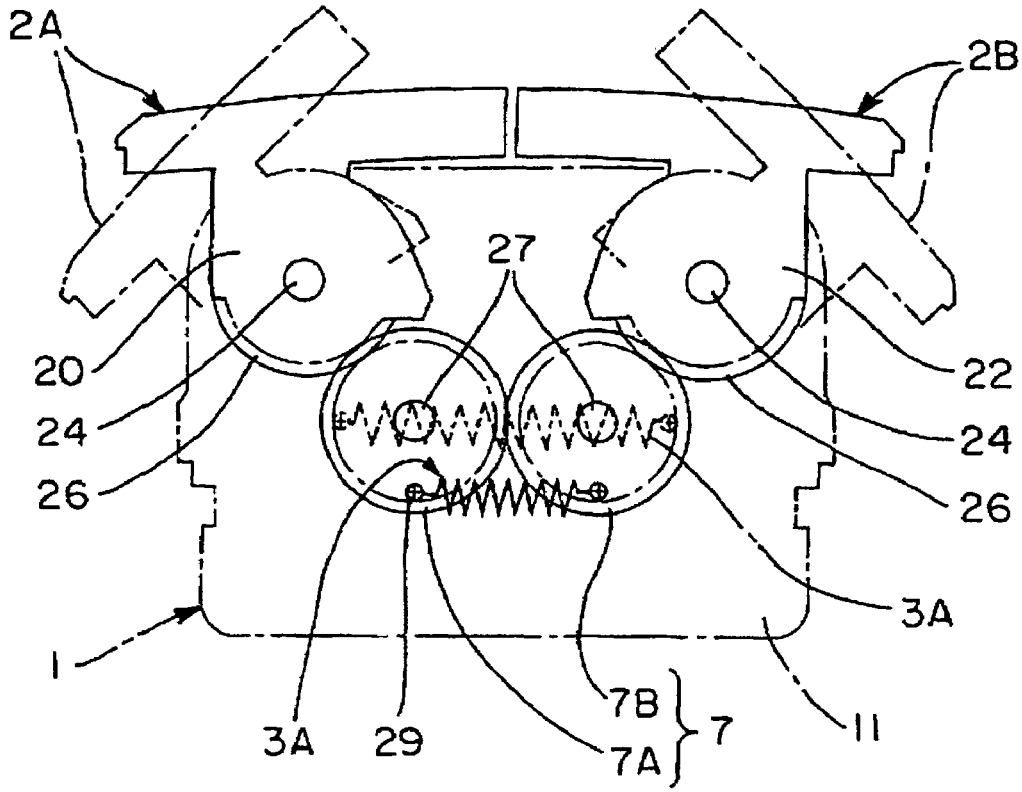
FIGS. 21(*a*) and 21(*b*) are schematic views showing the cover opening and closing device in FIGS. 20(*a*) and 20(*b*) viewed from the other side.
Figure 21B:
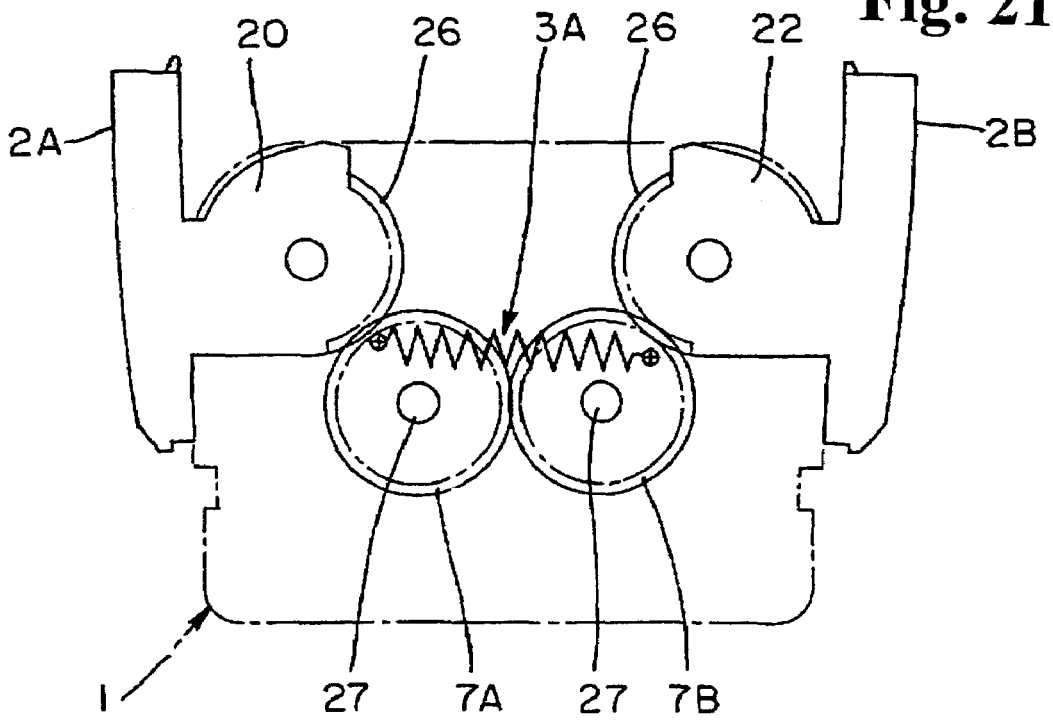

The main body 1, just as in the first embodiment, is partitioned by front and rear walls 11 and 12; a bottom wall 13; and reinforcing pieces or projecting walls 14 provided on both sides of the bottom wall 13. The entirety is housed inside the recess of the housing part. The main body 1, as shown in FIG. 17 and FIGS. 21(*a*) and 21(*b*), has a shaft 24 and an attachment part 15 protruding on the front wall 11; bracket attachment parts 16 and 16*a* protruding on the rear wall 12; and a shaft 24 doubling as an attachment part as well as a shaft 24*a*. On the rear wall 12, a bracket 9B is attached to the attachment parts 16 and 16*a* with screws 18 or the like. A button 4A is supported on the bracket 9B, and a fixed plate 65 on which a cam groove 66 is formed is fixed and supported. The cover bodies 2A and 2B are the same as those in the first embodiment. The front and rear arm parts 20 and 21 or 22 and 23 are pivotally supported with the shafts 24 on the corresponding front and rear walls 11 and 12 of the main body 1, and are switched to rotate between the closed position and the open position with the shafts 24 as fulcra. On the front arm part 20 of the cover body 2A and on the front and rear arm parts 22 and 23 of the cover body 2B, tooth shapes, that is, gear parts 25 or 26, are formed continuing on the arc-shaped perimeter part centered on the shaft 24. There is no gear part on the rear arm part 21 of the cover body 2A. A gear part for engaging with a damper device may be provided on the rear arm part 21.

The cover bodies 2A and 2B are pivotally supported with the shafts 24 on the main body 1, and are linked with the power transmitting device 7 on the front wall 11 of the main body 1, and with the operation button 4 and the switching device 5A as well as the engaging device (trace pin 78 and cam groove 66) on the side of the rear wall 12 of the main body 1. The switching device 5A has a moving body 60 which is slid in linkage with the push operation of the button 4A in a direction roughly intersecting with the direction of movement of the button 4A; a push 83 which is supported to be rotatable on the moving body 60; a gear 80 which is operationally linked to the push 83; and a trace pin 78 attached to the push 83 as a constituent member for engaging device.

The power transmitting device 7, as shown in FIGS. 21(*a*) and 21(*b*), comprises two mutually engaging idle gears 7A and 7B positioned on the front wall 11 of the main body 1 and respectively being pivotally supported with the shafts 27 between the front arm part 20 of the cover body 2A and the front arm part 22 of the cover body 2B. The power transmitting device 7 is made such that when the cover body 2B is rotated toward the direction of the open position with the shaft 24 as a fulcrum, by each engagement, the cover body 2A is rotated toward the direction of the open position in synchronization with the cover body 2B with the shaft 24 as a fulcrum.

The coil spring 3A is fixed at each end with the screws 29 or the like to the corresponding parts of the idle gears 7A and 7B. In this case, the coil spring 3A is provided for reversing the direction of forcing when the cover bodies 2A and 2B are in mid-course of being switched respectively between the closed position and the open position. That is, the coil spring 3A, for example, is charged (accumulating force) up to the mid-course position where the cover bodies 2A and 2B are switched toward the direction of the open position from the closed position, it reverses the direction of forcing a little before the cover bodies 2A and 2B reach the open position from the closed position. By the forcing, it automatically switches to rotate from the mid-course position to the open position. Such invertible-type spring is not limited to a configuration that switches the direction of forcing by contriving the placement of the coil spring 3A, and it also may be a torsion spring of the type that reverses an intermediate wound part between both ends.

Figure 18:
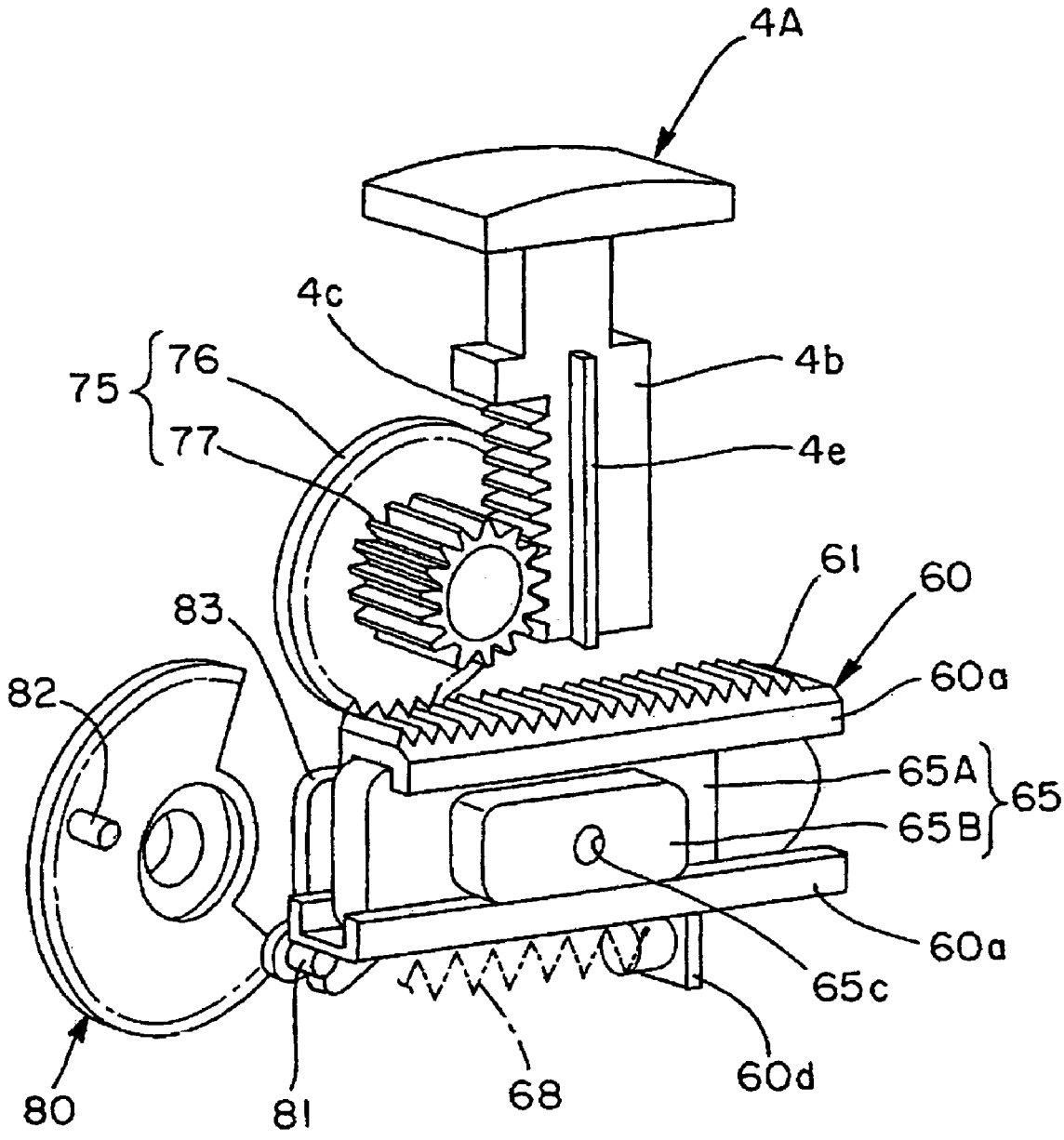
FIG. 18 is an external view showing essential components of the cover opening and closing device in FIG. 15.
Figure 19:
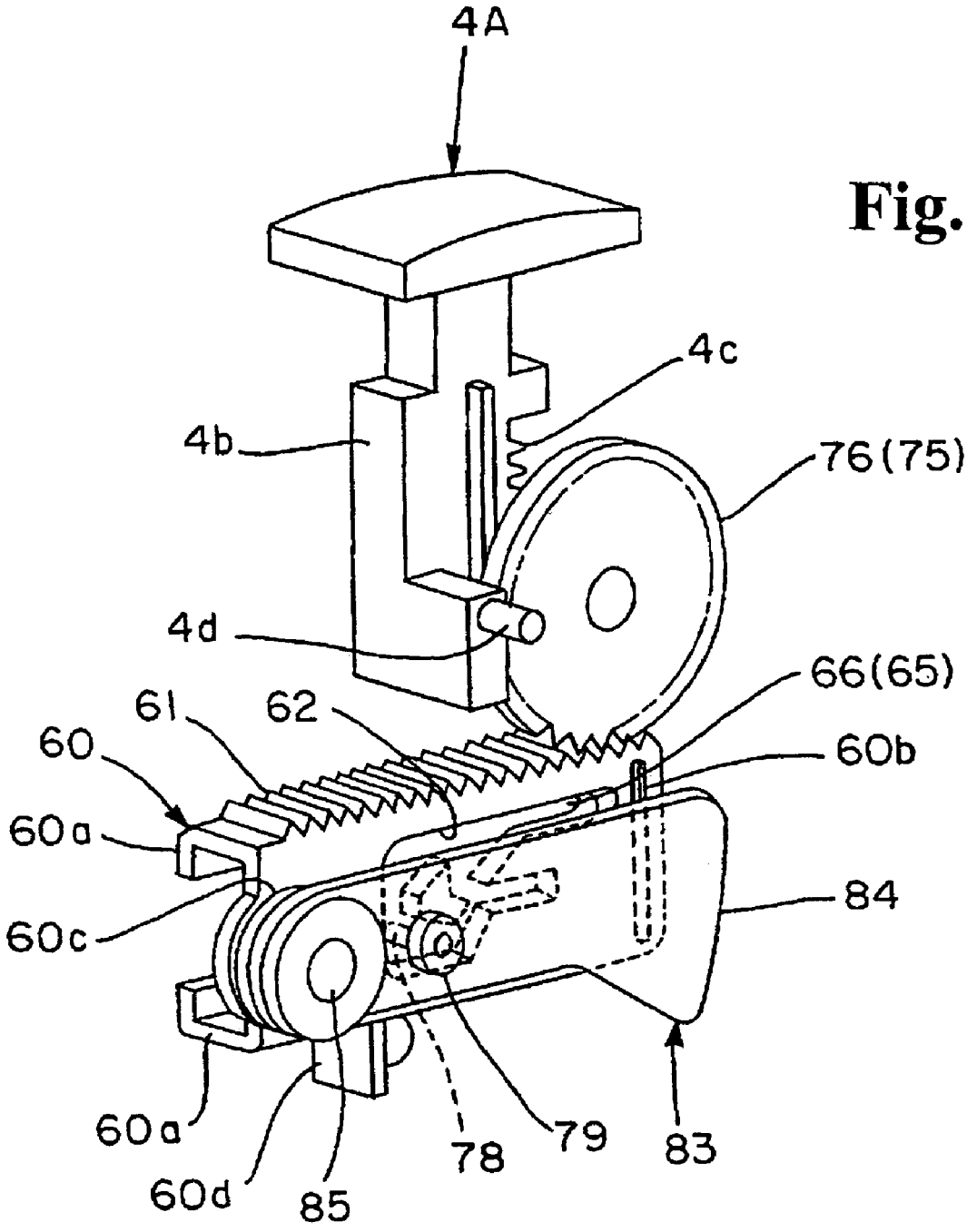
FIG. 19 is an external view showing the essential components of the cover opening and closing device similar to FIG. 18.
Figure 20A:
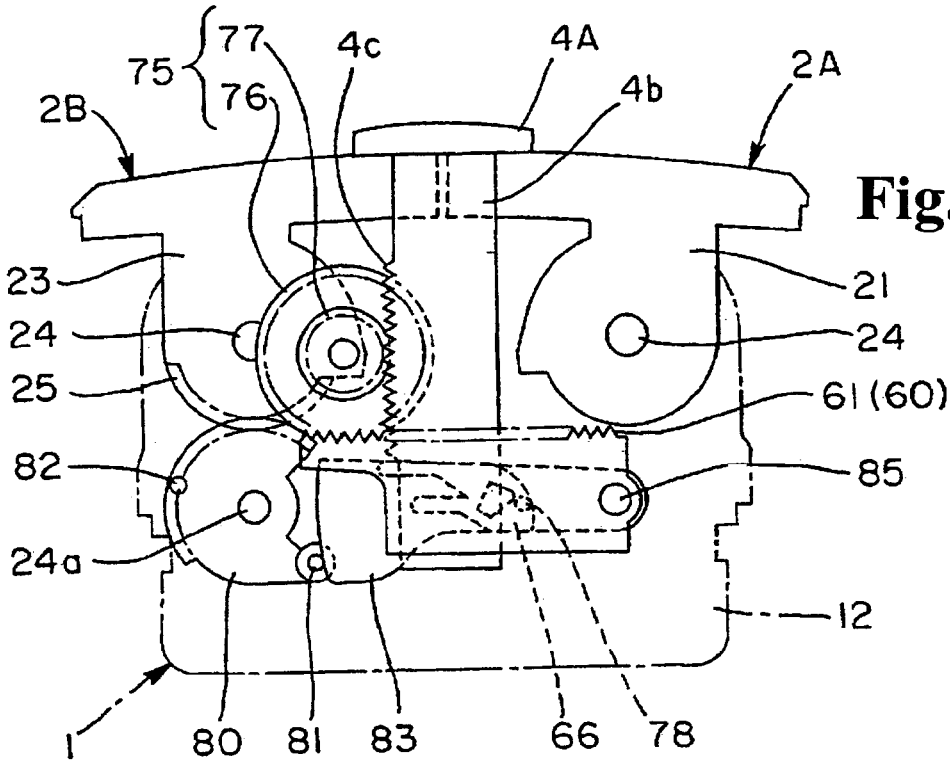
FIGS. 20(*a*) and 20(*b*) are schematic views showing the cover opening and closing device viewed from one side in a front-to-back direction of a main body according to the second embodiment.
Figure 20B:
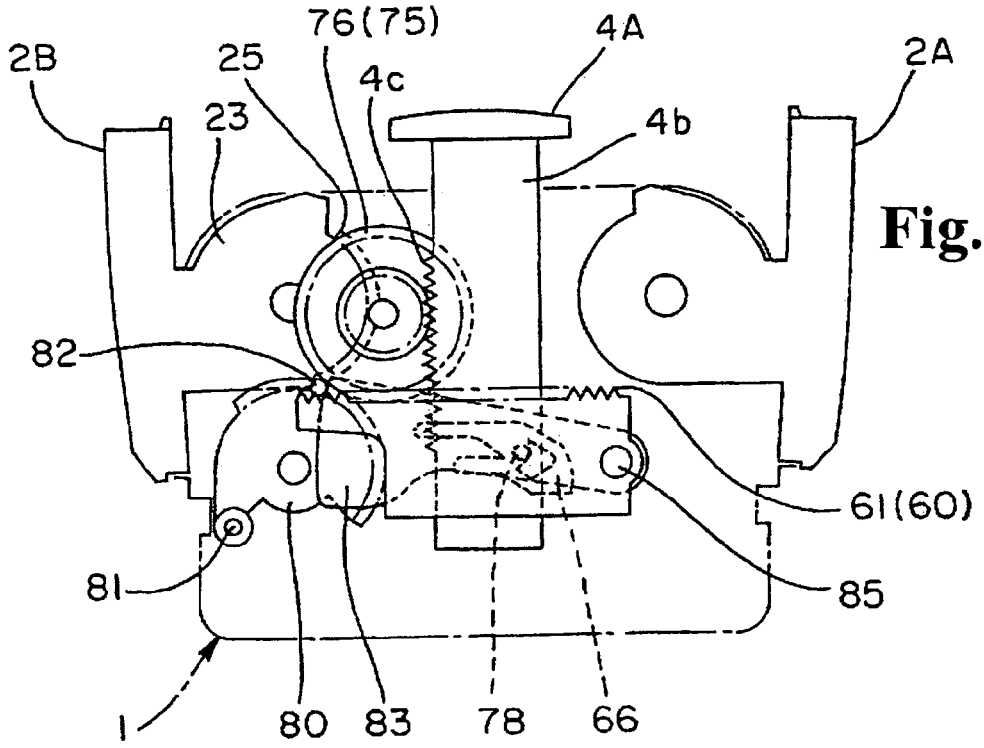

The operation button 4A, as shown in FIG. 16 to FIG. 19, has a roughly rectangular plate shape, and a plate part 4*b* projects integrally on the lower surface. The plate part 4*b* has a rack 4*c* which is provided along a surface on one side; a projection 4*d* which is provided on a projecting part on the inner surface; and a small rib 4*e* protruding in the vertical direction on the outer surface. A total size may be long as shown in FIGS. 20(*a*) and 20(*b*) to FIGS. 23(*a*) and 23(*b*). The button 4A is supported to move up and down freely on the outside of the rear wall 12 of the main body between a supporting plate 70 built in with the shafts 24 on both sides and a bracket 9B built in with the attachment parts 16 and 16*a*. The supporting part 70 is formed roughly in a T shape as shown in FIG. 17, and is attached to the rear wall 12. In the horizontal part 71 of the T shape, an escape slot 73 for inserting left and right shafts 24, and a shaft 74 which is placed on the left side between the shafts 24 are provided. In the vertical part 72 of the T shape, a guide groove 72*a* is provided in the vertical direction. The guide groove 72*a* guides the button 4A to move up and down freely by a prescribed amount in a state coupled with the projection 4*d*. The shaft 74 may be provided on the rear wall 12 of the main body and project from a hole on the support plate 70.

Figure 15:
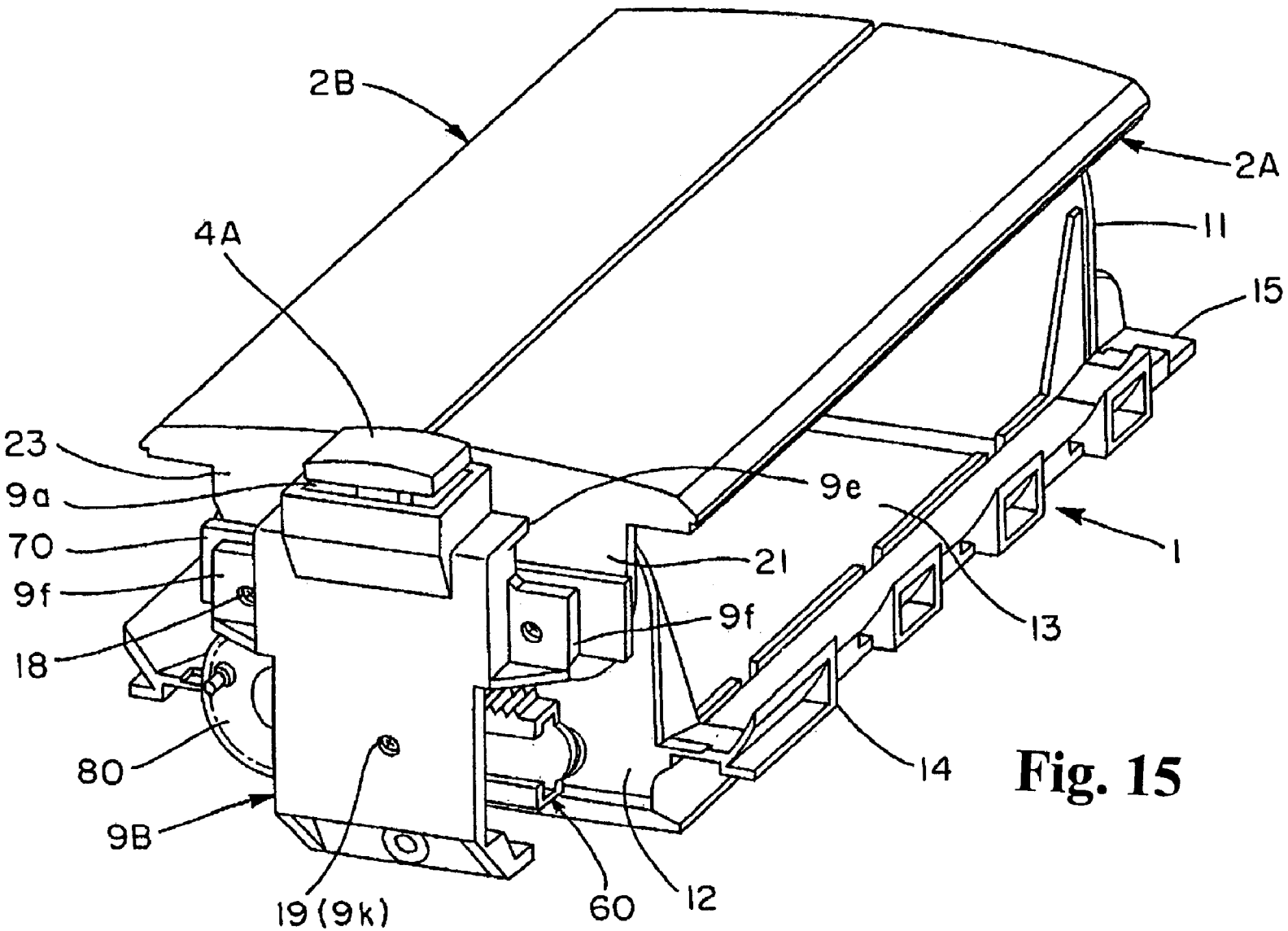
FIG. 15 is a view showing a cover opening and closing device corresponding to FIG. 9 according to a second embodiment of the present invention.
Figure 16:
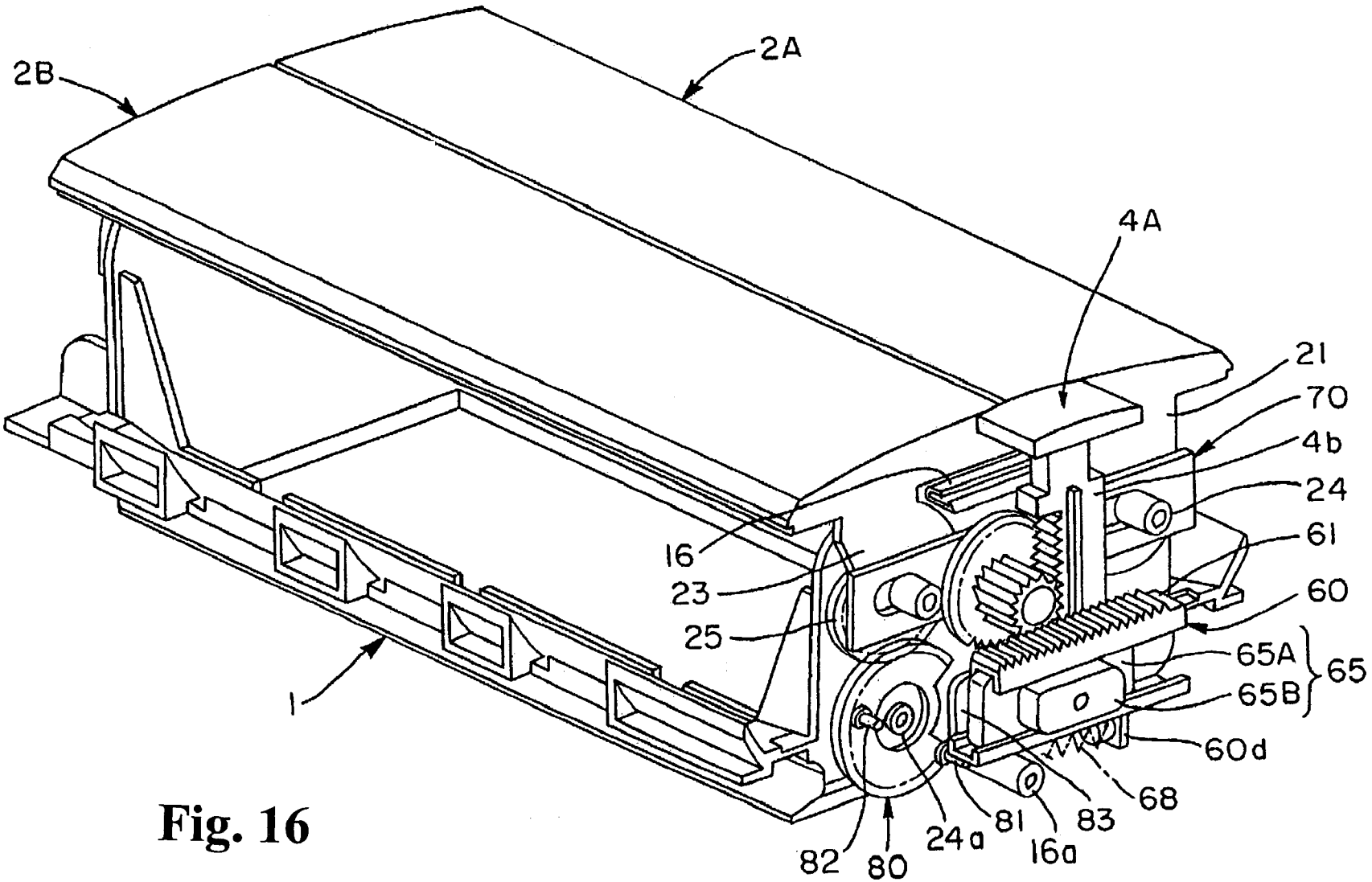
FIG. 16 is a view showing the cover opening and closing device in FIG. 15 without a bracket.

As shown in FIG. 15, the bracket 9B has integrally formed a recessed receiving part 9*a* for placing the operation button 4A; a guide part (not illustrated) which is provided on the inside of the receiving part 9*a* and couples to slide freely with the small rib 4*e* of the button 4A; tab parts 9*e* and 9*f* protruding on the front surface of the receiving part 9*a* and on both sides; and an attachment hole 9*k* which is provided in the center part. The bracket 9B is installed on the main body 1 on the rear wall 12 of the main body by coupling the tab part 9*e* and a corresponding part to the attachment parts 16 and 16*a* and fixing the corresponding tab part 9*f* to the shaft 24 of the main body 1 by screw 18, or the like. During the installation, the plate part 4*b* of the button 4 is supported to slide freely between the corresponding part on the inner surface of the bracket 9B and the support plate 70; a gear member 75 is supported on the shaft 74 of the support plate 70; the push 83 is attached to be rotatable with a pivot shaft 85 on the moving body 60; the moving body 60 is supported on the bracket 9B with the fixed plate 65; and the gear 80 is supported on the shaft 24*a* on the rear wall 12.

Figure 22A:
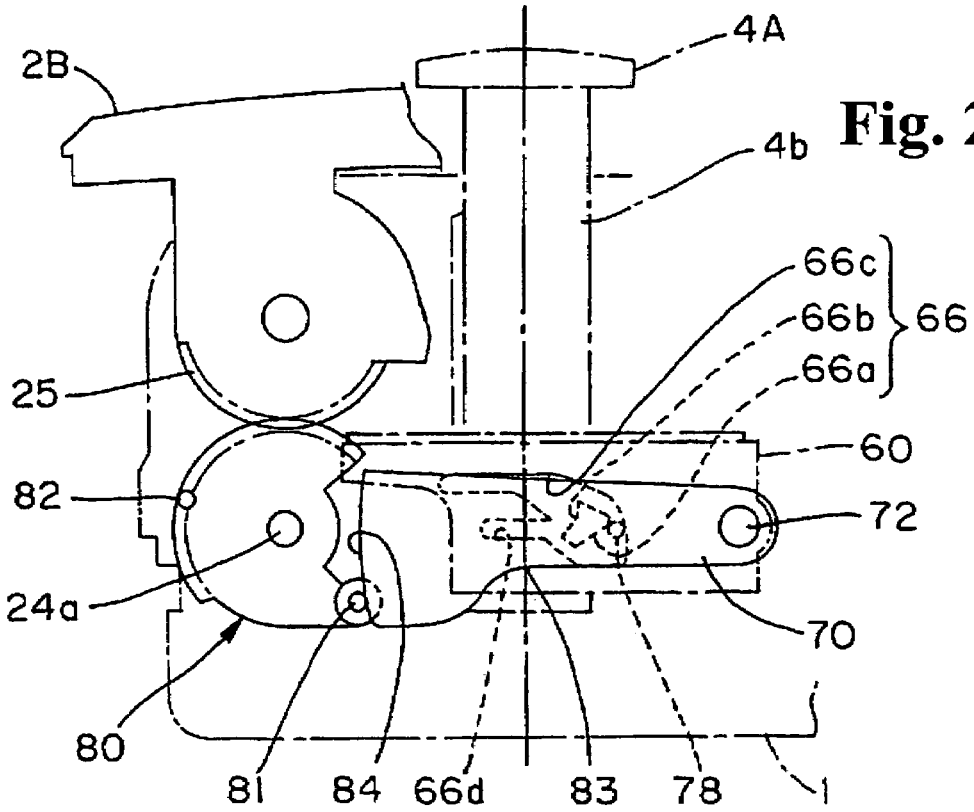
FIGS. 22(*a*) and 22(*b*) are schematic views showing the cover opening and closing device in FIGS. 20(*a*) and 20(*b*)
Figure 22B:
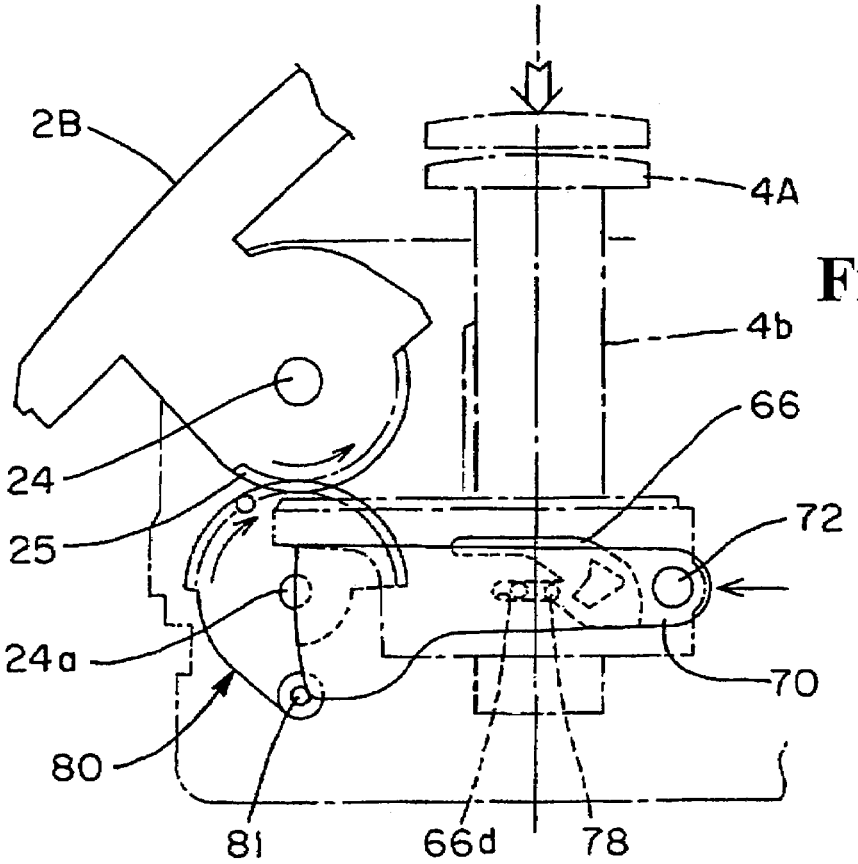

As shown in FIG. 18, the fixed plate 65 includes a plate part 65A which is coupled inside the moving body 60 and a plate part 65B which is placed protruding in the center part of the plate part 65A, and is installed on the bracket 9B by turning a screw 19 in an attachment hole 65*c* provided in the center of the fixed plate 65 from the attachment hole 9*k* on the side of the bracket (see FIG. 15). A cam groove 66 is provided in the plate part 65A. The cam groove 66 has a generally raised heart shaped island as shown in FIGS. 22(*a*) and 22(*b*) and FIGS. 23(*a*) and 23(*b*), and has a guiding cam groove for coupling 66*a*; a coupling groove 66*b*; a guiding cam groove for releasing 66*c* provided along the perimeter of the island; a stopper cam surface for coupling 66*d* which extends toward the left side from a place having past the guiding cam groove for coupling 66*a*; and a stopper cam surface which is positioned diagonally upward from the coupling groove 66*b* and inclined diagonally upwardly from the right side of the stopper cam surface 66*d*.

The gear member 75 has a large-diameter gear 76 and a pinion 77 which is provided coaxially on the outer end surface of that gear 76, and is supported to rotate freely on the shaft 74. The pinion 77 engages the rack 4*c*, and is rotated by the push operation of the button 4.

The moving body 60 generally has a square bracket section, and is supported to slide freely in the lateral direction on the fixed plate 65 in a state in which the fixed plate 65 is coupled inside the upper and lower side parts 60*a* and 60*a* of the square bracket shape. In the moving body 60, as shown in FIG. 19, a window part 62 which exposes the cam groove 66 in an intermediate plate part connecting the upper and lower side parts 60*a* and 60*a* is opened, and a rack 61 which engages the gear 76 of the gear member 75 is formed in the left-to-right direction along the upper side part 60*a*.

Symbols 60*b* and 60*c* are ribs which are provided on the back surface side of the moving body and fend off the push 83 to slide freely. That is, the push 83 has the end surface 84 on the free end side formed as an arc, and a trace pin 78 protruding through an attachment member 79. The push 83 is coupled such that the trace pin 78 is capable of sliding with the cam groove 66 via the window part 62 in a state in which the base end side is attached to be rotatable on the moving body 60 with the shaft pin 85. Symbol 60*d* is a spring fixing part protruding on the outer surface of the lower side part 60*a*. The corresponding ends of a coil spring 68 are fixed respectively on the fixing part 60*d* and a fixing part (not illustrated) protruding on a corresponding part of the rear wall of the main body (see FIG. 18). The coil spring 68 is charged when the moving body 60 is moved toward the right side through the engagement between the rack 4*c* and the pinion 77 and the engagement between the gear 76 and the rack 61. The cover bodies 2A and 2B are held in the open position by the coupling force between the trace pin 78 and the cam groove 66. When the coupling between the trace pin 78 and the cam groove 66 is released by the next push operation of the button 4, the cover bodies 2A and 2B are switched to rotate from the open position to the closed position with the power transmitting device 7 and the coil spring 3A. The coil spring 68 enables automatic returning of the moving body 60 and the push 83 to the original positions in linkage with its operation.

The gear 80 has outer perimeter teeth engaging the gear part 25 of the rear arm 23 constituting the cover body 2B, and two pins 81 and 82 protruding on the outer end surface. The pin 81 contacts the end surface 84 of the push 83 in the closed position of the cover bodies 2A and 2B, and the pin 82 contacts the end surface 84 of the push 83 in the open position of the cover bodies 2A and 2B.

(Operation)

Figure 23A:
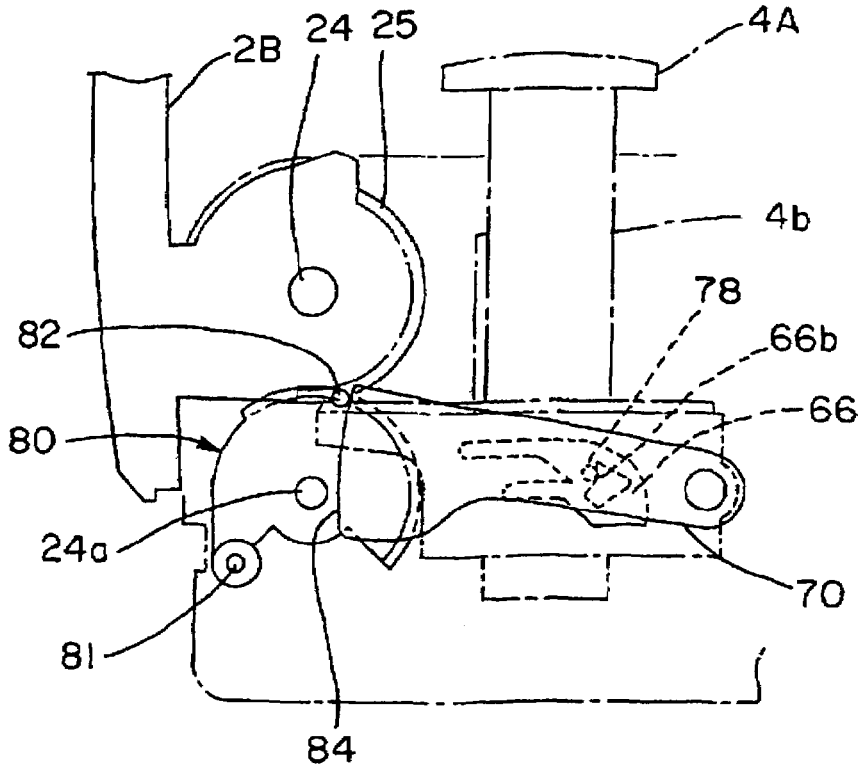
FIGS. 23(*a*) and 23(*b*) are schematic views showing the cover opening and closing device similar to FIGS. 22(*a*) and 22(*b*)
Figure 23B:
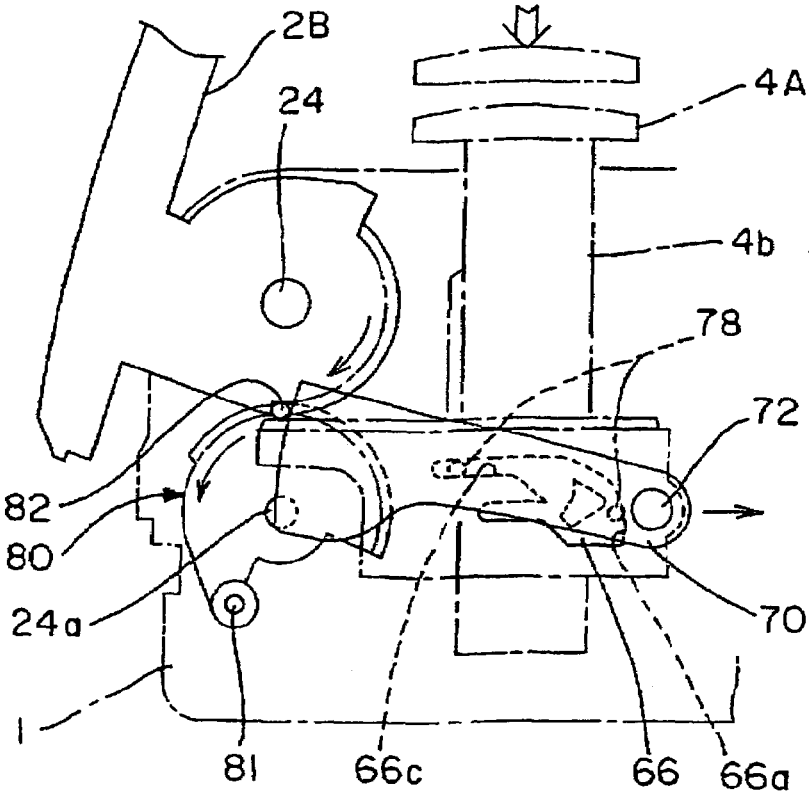
Figure 24A:
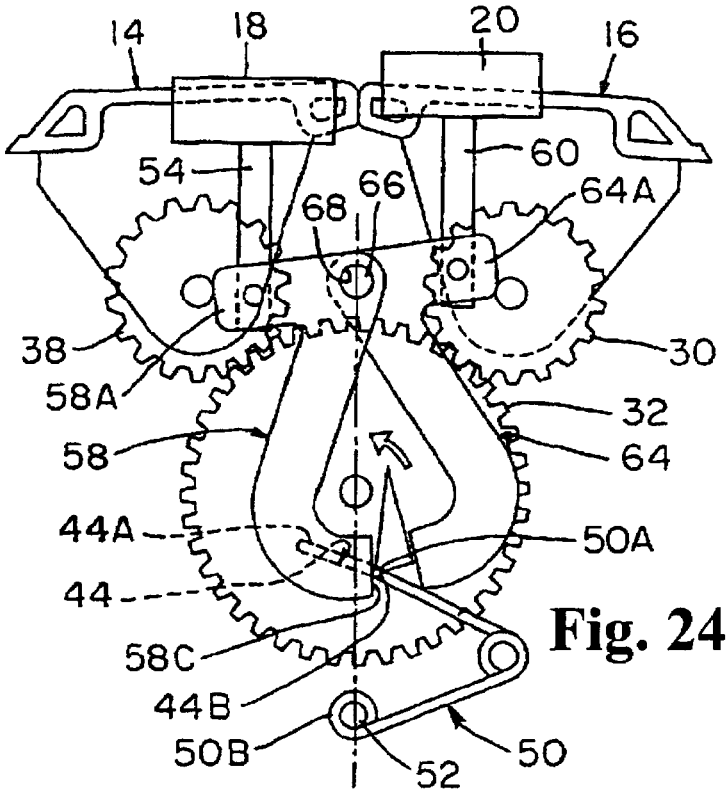
Fig. 24(a) Prior Art
FIGS. 24(*a*) and 24(*b*) are schematic views showing a conventional cover opening and closing device.
Figure 24B:
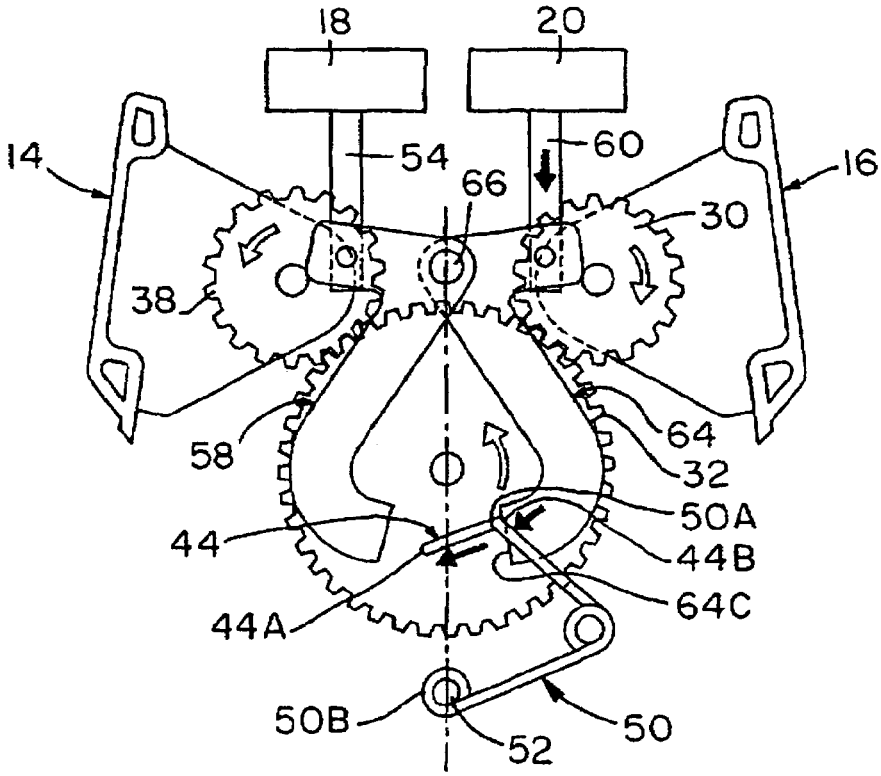
Fig. 24(b) Prior Art

An operation of the cover opening and closing device will be explained with reference to FIGS. 20(*a*) and 20(*b*) to FIGS. 23(*a*) and 23(*b*). The solid line in FIG. 20(*a*) and FIG. 21(*a*) show the closed position of the cover bodies, and FIG. 20(*b*) and FIG. 21(*b*) show the open position of the cover bodies. FIGS. 22 (*a*) and 22 (*b*) typically show the movement of the main members when the cover bodies are switched to rotate from the closed position to the open position. FIGS. 23(*a*) and 23(*b*) typically show the movement of the main members when the cover bodies are switched to rotate from the open position to the closed position. In FIGS. 20(*a*) and 20(*b*) and FIGS. 23(*a*) and 23(*b*), the coil spring 38 is omitted, and in FIGS. 22(*a*) and 22(*b*) and FIGS. 23(*a*) and 23(*b*), the movements of the cam groove 66 and the trace pin 78 (push 83) are typified for ease of understanding.

In the closed position of the cover bodies 2A and 2B, the cover bodies 2A and 2B are held by a strength corresponding to the spring pressure of the coil spring 3A fixed to both idle gears 27 engaging each gear part 26 of the arm part 20 of the cover body 2A and the arm 22 of the cover body 2B. The push 83 shown in FIG. 22(*a*) has a front end surface 84 contacting the pin 81 of the gear 80 in a state of sliding toward the left side together with the moving body 60. At this time, the trace pin 78 is positioned in the guiding cam groove for coupling 66*a* in the cam groove 66.

FIG. 22(*b*) shows the state in which the button 4A is pushed downwardly in order to switch the cover bodies 2A and 2B to the open position. When the button 4A is pushed by the finger or the like, the gear member 75 is rotated clockwise through the engagement between the gear 77 and the rack 4*c*. At the same time, the moving body 60 is slid toward the right side through the engagement between the gear 76 and the rack 61. Accordingly, the push 83 moves toward the same direction by the sliding of the moving body 60. The pin 81 is pressed by the front end surface 84 of the push 83, and the gear 80 is rotated clockwise by the pressing force. By the rotation of that gear 80, the cover body 2B is rotated up to the mid-course position between the closed position and the open position shown in FIG. 22(*b*) through the engagement with the gear part 25. In this process, the coil spring 3A becomes in the maximally charged state shown by the projected line in FIG. 21(*a*) from the state shown by the solid line, and the trace pin 78 reaches the stopper cam surface for coupling 66*d* from the guiding cam surface for coupling 66*a*. In this structure, after the coil spring 3A is maximally charged, the direction of forcing is reversed and the force is released as shown in FIG. 21(*b*), that is, the idle gears 7A and 7B are rotated automatically by the force. As a result, the cover bodies 2A and 2B are automatically switched to rotate up to the open position by the engagement between the idle gears 7A and 7B and the gear part 26. Thus, when the cover bodies 2A and 2B are switched to the open position, the gear 80 is rotated counterclockwise through the engagement with the gear part 25, the pin 81 is removed from the front end surface 84 of the push 83, and the pin 82 contacts. At the same time, the push 83 is moved somewhat toward the right side by the force of the coil spring 68 together with the moving body 60. As a result, the trace pin 78 moves from the stopper cam surface 66*d* up to the coupling groove 66*b* and couples. Accordingly, the cover bodies 2A and 2B are held in the open position in opposition to the force of the coil spring 3A.

FIG. 23(*b*) shows the state in which the button 4A is pushed in opposition to the force of the coil spring 3A in order to switch the cover bodies 2A and 2B from the open position to the closed position. When the button 4A is pushed down again, the gear member 75 in FIGS. 20(*a*) and 20(*b*) is rotated clockwise through the engagement between the gear 77 and the rack 4*c*. At the same time, the moving body 60 is slid toward the left side through the engagement between the gear 76 and the rack 61. Accordingly, the push 83 moves in the same direction by the sliding of the moving body 60. The pin 82 is pressed by the front end surface 84 of the push 83, and the gear 80 is rotated counterclockwise by that pressing force. By the rotation of the gear 80, the cover body 2B is rotated up to the mid-course position between the closed position and the open position shown in FIG. 23(*b*) through the engagement with the gear part 25. In this process, the coil spring 3A becomes in the maximally charged state shown by the projected line in FIG. 21(*a*) from the state in FIG. 21(*b*). The trace pin 78 enters the guiding cam groove for releasing 66*c* from the coupling groove 66*b*, and slides toward the left side of the guiding cam groove 66*c*. In this structure, after the coil spring 3A is maximally charged, the direction of forcing is reversed and the force is released as shown by the solid line in FIG. 21(*a*), that is, the idle gears 7A and 7B are rotated automatically by the force. As a result, the cover bodies 2A and 2B are automatically switched to rotate up to the closed position by the engagement between the idle gears 7A and 7B and the gear part 26. Thus, when the cover bodies 2*a* and 2*b* are switched to the closed position, the gear 80 is rotated counterclockwise through the engagement with the gear part 25. The pin 82 is removed from the front end surface 84 of the push 83, and the pin 81 contacts. At the same time, the push 83 is moved toward the right side by the force of the coil spring 68 together with the moving body 60. As a result, the trace pin 78 is returned from the guiding cam groove 66*c* to the original position in FIG. 22(*a*), that is, the guiding cam groove for coupling 66*a*.

Accordingly, in the second embodiment, the coil spring 3A reverses the direction of forcing in the mid-course of rotation of the cover bodies 2A and 2B. When the cover bodies 2A and 2B are switched from the closed position to the open position, or from the open position to the closed position, by the push operation of the button 4A by the user, they can be switched automatically by the force of the coil spring 3A from the mid-course of rotation by just slightly pushing the button 4A with the finger, or the like, and releasing. Therefore, in the structure, the operability of switching can be made better, and the reliability and quality of the apparatus can be greatly improved.

As described above, the cover opening and closing device of the present invention can eliminate the problems as mentioned. It is possible to assuredly eliminate the risk that the cover body might be switched to the open position unexpectedly by an impact load caused by a collision accident, or the like. It is possible to improve the operability of opening and closing, the placement space, and the external appearance characteristics. The present invention is not limited to the above-mentioned embodiments and modified examples, and the detailed parts of each means are capable of numerous modifications.

The disclosure of Japanese Patent Application No. 2004-141616, filed on May 11, 2004, is incorporated in the application.

While the invention has been explained with reference to the specific embodiments of the invention, the explanation is illustrative and the invention is limited only by the appended claims.

What is claimed is:

1. A cover opening and closing device for switching a cover body between a closed position and an open position, comprising:

one operation button to be operated when the cover body is switched between the closed position and the open position, a forcing device for forcing the cover body toward the closed position at least from a position close to the closed position when the cover body is closed, and a switching device for releasing the cover body at the open position so that the cover body rotates toward the closed position when the operation button is operated, said switching device including a cam rotating when the operation button is operated, a gear linked to the cam and engaging a gear part provided on the cover body, and an engaging device for holding the cover body at the open position and releasing the cover body when the operation button is operated, wherein said engaging device includes a sliding body disposed between the operation button and the cam and forming a cam groove, a trace pin for tracing the cam groove, and a lock member linked to the sliding body for moving in a direction intersecting with the sliding body.

2. A cover opening and closing device for switching a cover body between a closed position and an open position, comprising:

one operation button to be operated when the cover body is switched between the closed position and the open position, a forcing device for forcing the cover body toward the closed position at least from a position close to the closed position when the cover body is closed, and a switching device for releasing the cover body at the open position so that the cover body rotates toward the closed position when the operation button is operated, said switching device including a moving body sliding in a direction intersecting with a direction that the operation button moves when the operation button is operated, a push member swingably supported on the moving body, a gear linked to the push member and engaging a gear part provided on the cover body, and an engaging device for holding the cover body at the open position and releasing the cover body when the operation button is operated, wherein said engaging device includes a cam groove provided in a fixed plate fixed to a main body, and a trace pin provided on the push member for tracing the cam groove.

3. A cover opening and closing device according to claim 2, wherein said forcing device reverses a forcing direction when the cover body is situated at a middle point between the closed position and the open position.

* * * * *